US008926047B2

(12) United States Patent
LaCaze et al.

(10) Patent No.: US 8,926,047 B2
(45) **Date of Patent: *Jan. 6, 2015**

(54) APPARATUSES FOR PRINTING ON GENERALLY CYLINDRICAL OBJECTS AND RELATED METHODS

(75) Inventors: John R. LaCaze, Hampton Cove, AL (US); James Lambert, Hampton Cove, AL (US); Joseph Finan, Fort Mill, SC (US)

(73) Assignee: INX International Ink Company, Owens Cross Roads, AL (US)

( * ) Notice: Subject to any disclaimer, the term of this patent is extended or adjusted under 35 U.S.C. 154(b) by 129 days.

This patent is subject to a terminal disclaimer.

(21) Appl. No.: 13/457,138

(22) Filed: Apr. 26, 2012

(65) Prior Publication Data

US 2012/0274695 A1 Nov. 1, 2012

Related U.S. Application Data

(60) Provisional application No. 61/479,106, filed on Apr. 26, 2011.

(51) Int. Cl.

| | |
|---|---|
| ***B41J 29/38*** | (2006.01) |
| ***B41F 17/08*** | (2006.01) |
| ***B41J 29/02*** | (2006.01) |
| ***B41J 2/175*** | (2006.01) |
| ***B41J 3/407*** | (2006.01) |
| ***B41J 11/00*** | (2006.01) |

(52) U.S. Cl.

CPC ..... *B41J 29/02* (2013.01); *B41J 2/1752* (2013.01); *B41J 3/4073* (2013.01); *B41J 11/002* (2013.01)

USPC ..... 347/16; 101/40

(58) Field of Classification Search

USPC ..... 101/40; 347/16

See application file for complete search history.

(56) References Cited

U.S. PATENT DOCUMENTS

| | | | | |
|---|---|---|---|---|
| 5,592,202 | A | 1/1997 | Erickson | |
| 5,831,641 | A * | 11/1998 | Carlson | 347/2 |
| 6,135,654 | A * | 10/2000 | Jennel | 400/61 |
| 7,004,562 | B2 | 2/2006 | Madeley | |
| 7,111,915 | B2 | 9/2006 | Martinez et al. | |
| 2006/0250464 | A1 * | 11/2006 | Sheinman | 347/101 |
| 2010/0295885 | A1 | 11/2010 | LaCaze | |

FOREIGN PATENT DOCUMENTS

| | | |
|---|---|---|
| WO | WO2008132217 | 11/2008 |

* cited by examiner

*Primary Examiner* — Sarah Al Hashimi

(74) *Attorney, Agent, or Firm* — George P. Kobler; Lanier Ford Shaver & Payne P.C.

(57) ABSTRACT

An ink jet printer for printing on an at least partially cylindrical objects comprises one or more printheads positioned above a line of travel and a carriage assembly configured to hold an at least partially cylindrical object axially aligned along the line of travel and to position said object relative to the printheads, and then rotate the object relative to said one or more printheads. The printer also includes a curing device located along the line of travel and configured to emit energy suitable to cure the deposited fluid.

13 Claims, 35 Drawing Sheets

APPARATUSES FOR PRINTING ON GENERALLY CYLINDRICAL OBJECTS AND RELATED METHODS

CROSS-REFERENCE TO RELATED APPLICATIONS

This application claims priority to U.S. Provisional Application 61/479,106 filed, Apr. 26, 2011, which is incorporated by reference herein.

BACKGROUND

1. Field

The present invention relates generally to printing, and particularly, to printing on cylindrical objects, and more particularly to printing on hollow cylindrical objects, such as cans, and hollow, partially cylindrical objects, such as bottles.

2. Description of the Problem and Related Art

Current methods of printing indicia on cylindrical objects, such as cans or bottles, include either spray painting, gravure application, or the like, as is known in the art. While these methods have great utility in mass production of such objects, they do not lend themselves to other markets, such as novelty advertising on bottles, which benefit from the ability to change designs rapidly.

Ink jet printing is well-known, and because it can be digitally controlled using a computer, it has the flexibility to allow a user to change designs as desired. Only recently, however, have advances in technology been made to enable true image rendering on non-planar objects. For example, U.S. Pat. No. 7,111,915 entitled, Methods and Apparatus for Image Transfer, issued Sep. 26, 2006, to Martinez, and LaCaze (one of the inventors herein) and which is incorporated herein fully by reference, describes an ink jet printer for the printing of indicia on solid non-planar objects such as baseball bats. Multiple bats are held in a horizontal carousel structure and are positioned relative to printheads and then rotated in relation to the printhead which is computer-controlled to apply ink according to a programmed image file.

However, this structure is not suitable for hollow cans or two-piece bottles. What is needed is a programmable ink jet printer that allows for the proofing of two-piece can and bottle designs, without the complexity and cost associated with in-line can and bottle production and printing, as well as allowing for low-speed, high-quality, flexible commercial production with instantaneously variable images on the object.

Another example, specifically for cylindrical objects, such as cans or bottles, is found in the co-owned, and co-pending, U.S. Pub. App. 2010/0295885, entitled Apparatuses for Printing on Generally Cylindrical Objects and Related Methods, published Nov. 25, 2010 by LaCaze (one of the inventors herein) and which is incorporated herein fully by reference, describes an ink jet printer for the printing of generally cylindrical objects such as cans and bottles. Generally cylindrical objects, such as cans and bottles, are positioned relative to printheads by a combination of axial and rotary motion, as well as indexing without the printheads jetting ink. The object is conveyed to a "tunnel" formed by the printheads that is transverse to the axis along which the object travels, where the printheads are disposed at the same axial position. Alternatively, multiple printheads may be disposed singularly in series, along the axis of travel. The printheads are computer-controlled to apply ink according to a programmed image file.

SUMMARY

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that combines certain features of various embodiments and still be within the scope contemplated by the appended claims.

Disclosed hereinbelow is an apparatus for non-contact printing of images on generally cylindrical objects, particularly hollow cylindrical objects or hollow partially-cylindrical objects, for example, cans and bottles and including two-piece cans and bottles. It will also be apparent to one skilled in the relevant arts with the benefit of reading this disclosure that solid cylindrical objects and solid partially-cylindrical objects may also be printed by the described apparatuses.

In the one embodiment, each hollow cylindrical object is either hand-loaded or mechanically loaded via automation, utilizing structures and controls already known in the art, and secured by vacuum on a mandrel to prevent slippage, which is part of a carriage assembly that functions to convey the object along an axis of travel, (or axially, as used herein) beneath a series of digitally-controlled printheads and rotate the object in front of such printheads while ink is deposited to the object, in order to produce the desired printed design. The ink is also either partially or fully cured immediately after printing by an energy-emitting means positioned directly beneath the object, which is able to function while beneath the printheads or anytime during the functioning of the invention.

An exemplary carriage assembly may be mounted to a slide actuator, which is in turn fixedly mounted to a mounting frame, whereby the carriage assembly is free to traverse along the slide actuator. Also attached to said frame is any number of print tunnels containing—in the described first embodiment—four printheads capable of depositing four individual colors, or coatings, lacquers or overvarnish as known in the present art.

In the preferred operation of the first embodiment, the carriage advances the object through the first print tunnel, thereby under the printheads, while the object is rotated in synchronization with the deposition of ink from the computer-controlled printheads, said ink delivered from supply means located above the print tunnel. Such sequencing of the deposition of ink, rotation of the object and axial advancement thereof is variable, being dictated by several input factors, including desired print design and resolution, object diameter and length, printhead length and deposition rate, desired ink density, as well as axial displacement, or staggering of the printheads to achieve the desired results. The exact amount of axial printhead staggering is dictated by the aforementioned input factors, with the intention of keeping the object in continuous axial/rotary motion within the print tunnel(s) while simultaneously printing on the object, maximizing effective printing speed/efficiency and minimizing the time the printheads are not jetting ink. Simultaneously the energy-emitting means either partially or completely cures the ink. The carriage continues to axially advance the object in synchronization with its rotation and the jetting of ink from the printheads such that the entire length of the object may be printed by the first print tunnel.

The axial advancement/rotating/energy emitting action may for as many print tunnels as are being utilized to complete the intended printed design on the object. In one embodiment, the carriage axially returns to the loading position, ejects the object, and is then ready for loading the next object. However, the invention should not be understood as limited to this ejection, return and loading sequence as these functions may be performed in any order. Additionally, the drawings illustrate two print tunnels with four printheads each, but the number of print tunnels and/or the number of printheads per print tunnel should not be considered a limiting factor.

Examples of loading and unloading hollow cylindrical objects—such as cans and cups that are used to make cans—via automation utilizing structures and controls already known in the art are disclosed in U.S. Pat. No. 4,921,093 entitled Infeed Means for High Speed Continuous Motion Decorator, issued May 1, 1990 to Peters, Hamot and Ver Hoven; U.S. Pat. No. 4,928,511 entitled Rotary Cup Infeed, issued May 29, 1990 to Sirvet; U.S. Pat. No. 5,231,926 entitled Apparatus and Method for Substantially Reducing Can Spacing and Speed to Match Chain Pins, issued Aug. 3, 1993 to Williams, Sirvet, Gabel and Burke; U.S. Pat. No. 5,566,567 entitled Rotary Cup Infeed, issued Oct. 22, 1996 to Main; U.S. Pat. No. 5,749,631 entitled Dual Can Rotating Transfer Plate to Conveyor Belt, issued May 12, 1998 to Williams; and U.S. Pat. No. 6,467,609 entitled Can Transfer Rotating Plate System, issued Oct. 22, 2002 to Williams and Di Donato.

In an alternative operation of the first embodiment, the object continues to be printed as the carriage assembly returns to the loading position versus traversing through the print tunnel(s) without the printheads jetting ink, as in the preferred operation. The carriage axially advances back to the loading position while simultaneously rotating and printing the object via a second pass to complete any desired printing not achieved during the first pass beneath the printheads within the print tunnel(s). This serves to further maximize effective printing speed/efficiency by further minimizing the time the printheads are not jetting ink. As with the first pass, during the second (return) pass the energy-emitting means simultaneously either partially or completely cures the ink. The object may pass through the print tunnel(s) for as many repetitions as necessary in either direction to complete the desired printed design at the desired print resolution and ink density. After the desired design is completely printed, the object returns to the loading position—either having been printed during such return axial motion or not, where it is blown off and the next object is loaded and ready to be printed.

In a second embodiment of the invention, each hollow partially-cylindrical object (or bottle) is either hand-loaded or mechanically loaded via automation, utilizing structures and controls already known in the art, and secured at the closed end by vacuum on an object holding assembly and at the open end by an object clamping assembly, which are both part of a carriage assembly that functions to axially position the bottle beneath a series of digitally-controlled printheads and rotate the bottle in front of such printheads while ink is deposited to the bottle, in order to produce the desired printed design. The ink is also either partially or fully cured immediately after printing by an energy-emitting means positioned directly beneath the bottle, which is able to function while beneath the printheads or anytime during the functioning of the invention.

The carriage assembly is fixedly mounted to a slide actuator, which is in turn fixedly mounted to a mounting frame, whereby the carriage assembly is free to traverse along the slide actuator. Also attached to said frame is any number of print tunnels containing—as in the described first embodiment—four printheads capable of depositing four individual colors, or coatings, lacquers or overvarnish as known in the present art.

In the preferred operation of this second embodiment—as with the preferred operation of the first embodiment—the carriage axially advances the object through the first print tunnel, thereby under the printheads, while the object is rotated in synchronization with the deposition of ink from the computer-controlled printheads, said ink delivered from supply means located above the print tunnel. Such sequencing of the deposition of ink, rotation of the object and axial advancement thereof is variable, being dictated by several input factors, including desired print design and resolution, object diameter and length, printhead length and deposition rate, desired ink density, as well as axial displacement, or staggering of the printheads to achieve the desired results. The exact amount of staggering is dictated by the aforementioned input factors, with the intention of keeping the object in continuous axial/rotary motion within the print tunnel(s) while simultaneously printing the object, with the intention of maximizing effective printing speed/efficiency by minimizing the time the printheads are not jetting ink. Simultaneously the energy-emitting means either partially or completely cures the ink. The carriage continues to axially advance the object in synchronization with its rotation and the jetting of ink from the printheads such that the entire length of the object may be printed by the first print tunnel.

As with the first embodiment, in this second embodiment the axial advancement/rotating/energy emitting functions continue for as many print tunnels as are being utilized to complete the intended printed design on the object. Again, the carriage axially returns to the loading position, ejects the object, and is then ready for loading the next object. However, the invention should not be understood as limited to this ejection, return and loading sequence as these functions may be performed in any order. Additionally, the drawings illustrate two print tunnels with four printheads each, but the number of print tunnels and/or the number of printheads per print tunnel should not be considered a limiting factor.

Examples of loading and unloading hollow partially cylindrical objects—such as bottles—via automation utilizing structures and controls already known in the art are disclosed in U.S. Pat. No. 4,199,049 entitled Bottle Unscrambler and Loader, issued Apr. 22, 1980 to Vamvakas; U.S. Pat. No. 4,530,433 entitled Bottle-Holder Pincers Forming a Link in a Conveyor Chain, issued Jul. 23, 1985 to Cucchetto; U.S. Pat. No. 6,109,429 entitled Oriented Bottle Conveyor, issued Aug. 29, 2000 to Messer; U.S. Pat. No. 6,748,983 entitled Conveyor for Bottle-Filling Machine, issued Jun. 15, 2004 to Bausch; and U.S. Pat. No. 7,229,110 entitled Bottle Loading and Unloading Tool with Extendable Arms, issued Jun. 12, 2007 to Tye.

In an alternative operation of the second embodiment, the object continues to be printed as the carriage assembly returns to the loading station versus traversing through the print tunnel(s) without the printheads jetting ink, as in the preferred operation. The carriage axially advances back to the loading position while simultaneously rotating the bottle to complete any printing not achieved during the first pass beneath the printheads within the print tunnel(s). This serves to further maximize effective printing speed/efficiency by further minimizing the time the printheads are not jetting ink. As with the first pass, during the second (return) pass the energy-emitting means simultaneously either partially or completely cures the ink. The bottle may pass through the print tunnel(s) for as many repetitions as necessary in either direction to complete the desired printed design at the desired print resolution and ink density. After the desired design is completely printed, the bottle returns to the loading position, the object clamping assembly releases the open end of the bottle and air is applied to the object holding assembly to release the bottle, which may be unloaded by hand or mechanically unloaded via automation utilizing structures and controls already known in the art; the next bottle is then ready for loading.

In a third embodiment, each hollow cylindrical object, may be either hand-loaded or mechanically loaded via automation utilizing structures and controls already known in the art, and secured by vacuum on a mandrel to prevent slippage, which is part of a carriage assembly that functions to axially position the object relative to a series of digitally-controlled printheads and rotate the object in front of such printheads while ink is deposited to the object surface, in order to produce the desired printed design. The ink is also either partially or fully cured immediately after printing by an energy-emitting means positioned directly beneath the object, which is able to function while beneath the printheads or anytime during the functioning of the invention.

The carriage assembly is fixedly mounted to a slide actuator, which is in turn fixedly mounted to a mounting frame, whereby the carriage assembly is free to traverse along the slide actuator. Also attached to the frame is any number of print tunnels containing four printheads capable of depositing four individual colors, or coatings, lacquers or overvarnish as known in the present art.

In the preferred operation of the third embodiment, the carriage axially advances the object through the first print tunnel, thereby under the printheads, while the object is rotated in synchronization with the deposition of ink from the computer-controlled printheads, said ink delivered from supply means located above the print tunnel. Such sequencing of the deposition of ink, rotation of the object and axial advancement thereof is variable, being dictated by several input factors, including desired print design and resolution, object diameter and length, printhead length and deposition rate, desired ink density, as well as axial displacement, or staggering of the printheads to achieve the desired results. The exact amount of staggering is dictated by the aforementioned input factors, with the intention of keeping the object in continuous axial/rotary motion within the print tunnel(s) while simultaneously printing the object, with the intention of maximizing effective printing speed/efficiency by minimizing the time the printheads are not jetting ink. Simultaneously the energy-emitting means either partially or completely cures the ink. The carriage continues to axially advance the object in synchronization with its rotation and jetting of ink such that the entire length of the object may be printed by the first print tunnel. The axial advancement/rotating/energy emitting functions continue for as many print tunnels as are being utilized to complete the intended printed design on the object. The carriage continues to axially advance the object in the same direction as when printing, until it reaches the opposite end of the printer, where there is located another loading position, ejects the printed object, and is then ready for loading the next object at this second loading position located at the opposite end of the first loading position. This serves to further maximize effective printing speed/efficiency by further minimizing the time the printheads are not jetting ink.

In an alternative operation of the third embodiment, the object continues to be printed as the carriage assembly returns toward the original loading position, while simultaneously rotating and printing the object via a second pass to continue any desired printing not completed during the first pass beneath the printheads within the print tunnel(s). As with the first pass, during the second pass the energy-emitting means simultaneously either partially or completely cures the ink. The object then reverses direction again for an additional, or third pass through the print tunnel(s) until it reaches the end opposite the original loading position, where is located the aforementioned second loading position, blows the printed object off via compressed air, and is then ready for loading the next object at this second loading position located at the opposite end of the first loading position. This alternative operation of the third embodiment is meant to accommodate designs requiring 3 or more odd-numbered passes as determined by the design input factors, while maximizing effective printing speed/efficiency by further minimizing the time the printheads are not jetting ink.

In a fourth embodiment, each hollow partially-cylindrical object (or bottle) is either hand-loaded or mechanically loaded via automation utilizing structures and controls already known in the art and secured at the closed end by vacuum on an object holding assembly and at the open end by an object clamping assembly, which are both part of a carriage assembly that functions to axially position the bottle relative to a series of digitally-controlled printheads and rotate the bottle in front of such printheads while ink is deposited to the bottle, in order to produce the desired printed design. The ink is also either partially or fully cured immediately after printing by an energy-emitting means positioned directly beneath the bottle, which is able to function while beneath the printheads or anytime during the functioning of the invention.

The carriage assembly is fixedly mounted to a slide actuator, which is in turn fixedly mounted to a mounting frame, whereby the carriage assembly is free to traverse along the slide actuator. Also attached to the frame is any number of print tunnels containing four printheads capable of depositing four individual colors, or coatings, lacquers or overvarnish as known in the present art.

In the preferred operation of the fourth embodiment, the carriage axially advances the object through the first print tunnel, thereby under the printheads, while the bottle is rotated in synchronization with the deposition of ink from the computer-controlled printheads, said ink delivered from supply means located above the print tunnel. Such sequencing of the deposition of ink, rotation of the bottle and axial advancement thereof is variable, being dictated by several input factors, including desired print design and resolution, bottle diameter and length, printhead length and deposition rate, desired ink density, as well as axial displacement, or staggering of the printheads to achieve the desired results. The exact amount of staggering is dictated by the aforementioned input factors, with the intention of keeping the bottle in continuous axial/rotary motion within the print tunnel(s) while simultaneously printing the bottle, thereby maximizing effective printing speed/efficiency by minimizing the time the printheads are not jetting ink. Simultaneously the energy-emitting means either partially or completely cures the ink. The carriage continues to axially advance the bottle in synchronization with its rotation such that the entire length of the bottle may be printed by the first print tunnel.

The axial advancement/rotating/energy emitting functions continue for as many print tunnels as are being utilized to complete the intended printed design on the bottle. The carriage continues to axially advance the bottle in the same direction as when printing, until it reaches the opposite end of the printer, where there is located another loading position, the object clamping assembly releases the open end of the bottle and air is applied to the object holding assembly to release the bottle; the next bottle is then ready for loading. The present invention drawings illustrate two print tunnels with four printheads each, but the number of print tunnels and/or the number of printheads per print tunnel should not be considered a limiting factor.

Examples of loading and unloading hollow partially cylindrical objects—such as bottles—via automation utilizing structures and controls already known in the art are already described within the second embodiment (U.S. Pat. Nos. 4,199,049; 4,530,433; 6,109,429; 6,748,983; 7,229,110).

In an alternative operation of the fourth embodiment, the bottle continues to be printed as the carriage assembly returns toward the original loading position, while simultaneously rotating and printing the bottle via a second pass to continue any desired printing not completed during the first pass beneath the printheads within the print tunnel(s). This serves to further maximize effective printing speed/efficiency by further minimizing the time the printheads are not jetting ink. As with the first pass, during the return pass the energy-emitting means simultaneously either partially or completely cures the ink. The bottle then reverses direction again for an additional, or third pass through the print tunnel(s) until it reaches the end opposite the original loading position, where is located the aforementioned second loading position, the object clamping assembly releases the open end of the bottle and air is applied to the object holding assembly to release the bottle; the next bottle is then ready for loading. This alternative operation of the fourth embodiment is meant to accommodate designs requiring 3 or more odd-numbered passes as determined by the design input factors, while maximizing effective printing speed/efficiency by further minimizing the time the printheads are not jetting ink.

These and other embodiments of the present invention will also become readily apparent to those skilled in the art from the following detailed description of the embodiments having reference to the attached figures, the invention not being limited to any particular embodiment(s) disclosed.

BRIEF DESCRIPTION OF THE DRAWINGS

The present invention is described with reference to the accompanying drawings. In the drawings, like reference numbers indicate identical or functionally similar elements.

DETAILED DESCRIPTION

The various embodiments of the present invention and their advantages are best understood by referring to FIGS. 1 through 35 of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

Figure 1:
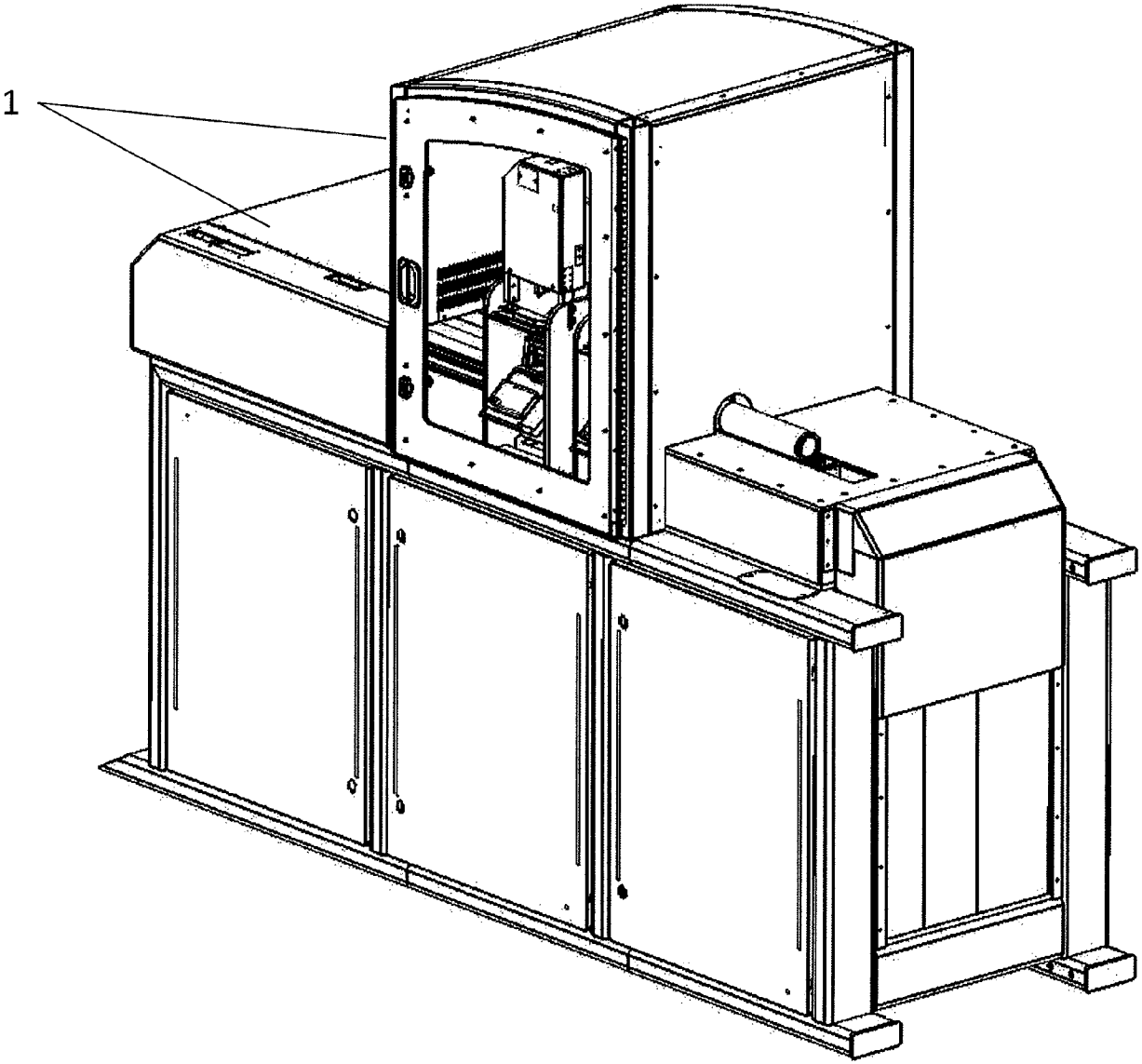
FIG. 1 shows an exemplary digital printing apparatus for decorating hollow cylindrical objects.
Figure 2:
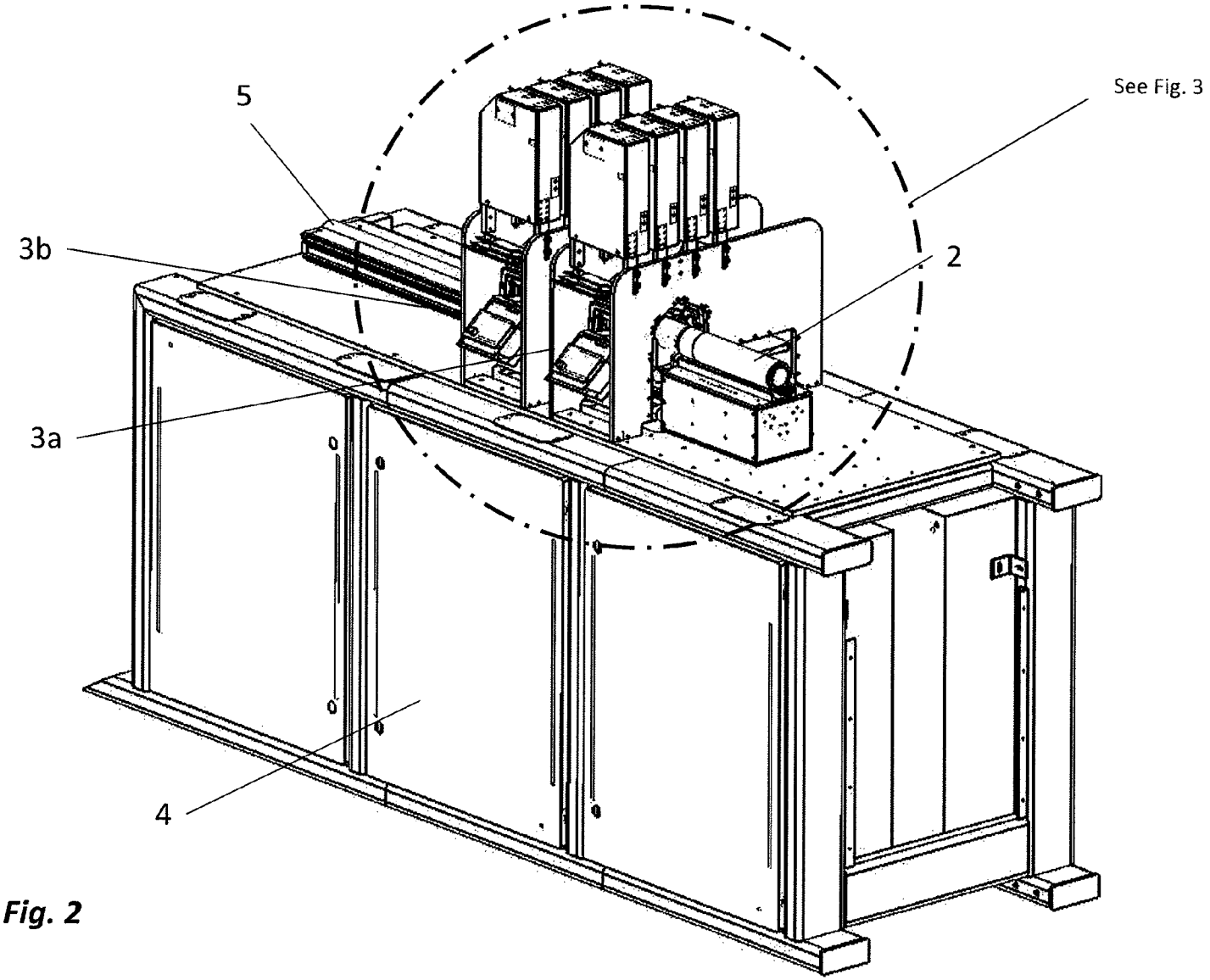
FIG. 2 depicts the apparatus with top covers removed for clarity.

Referring first to FIG. 1, an exemplary digital printing apparatus for decorating cylindrical objects, for example, cans is illustrated with top covers 1 in place. FIG. 2 depicts the invention with top covers 1 removed for clarity. The apparatus comprises four main, interconnected components: carriage assembly 2, print tunnels 3*a*, 3*b*, support frame 4, and slide actuator 5. The slide actuator 5 and print tunnels 3*a*, 3*b* are both connected directly to the support frame 4. The carriage assembly 2 is in turn mounted directly to the slide actuator 5.

Figure 3:
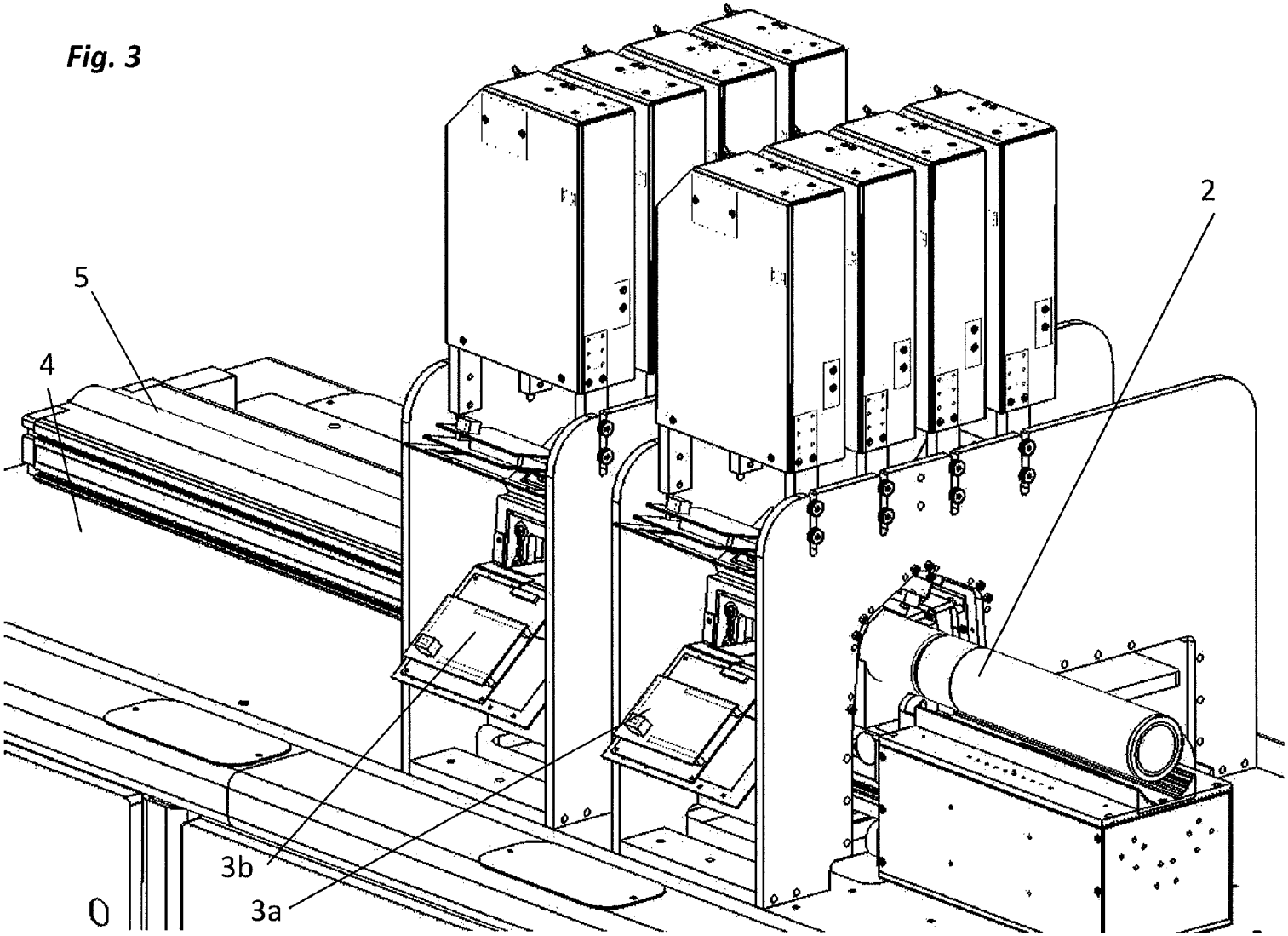
FIG. 3 is a close-up view of the major components printing apparatus.
Figure 4:
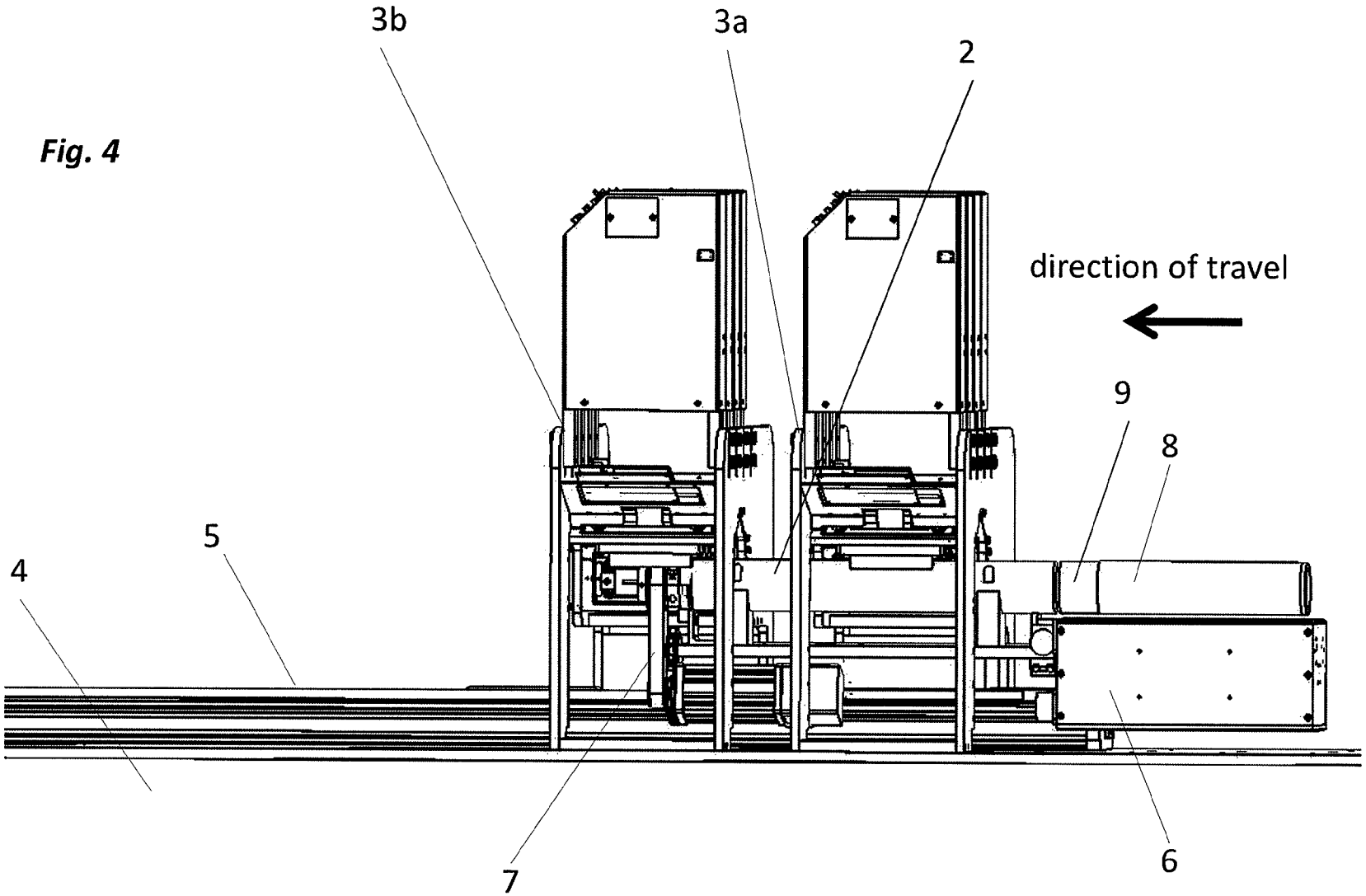
FIG. 4 is a side elevation of the printing apparatus.

FIG. 3 is a close-up view showing the relationship between the carriage assembly 2, print tunnels 3*a*, 3*b* and mounting frame 4, as well as the slide actuator 5 on which the carriage assembly 2 axially traverses. FIG. 4 is a side elevation of the apparatus showing the energy curing assembly 6, rotational drive assembly 7, and hollow cylindrical object 8 to be printed. The slide actuator 5 transports the carriage assembly 2 into the print tunnels 3*a*, 3*b* while the rotational drive assembly 7 rotates the carriage assembly 2, and thus, the hollow cylindrical object to be printed 8 within the print tunnels 3*a*, 3*b*.

Figure 5:
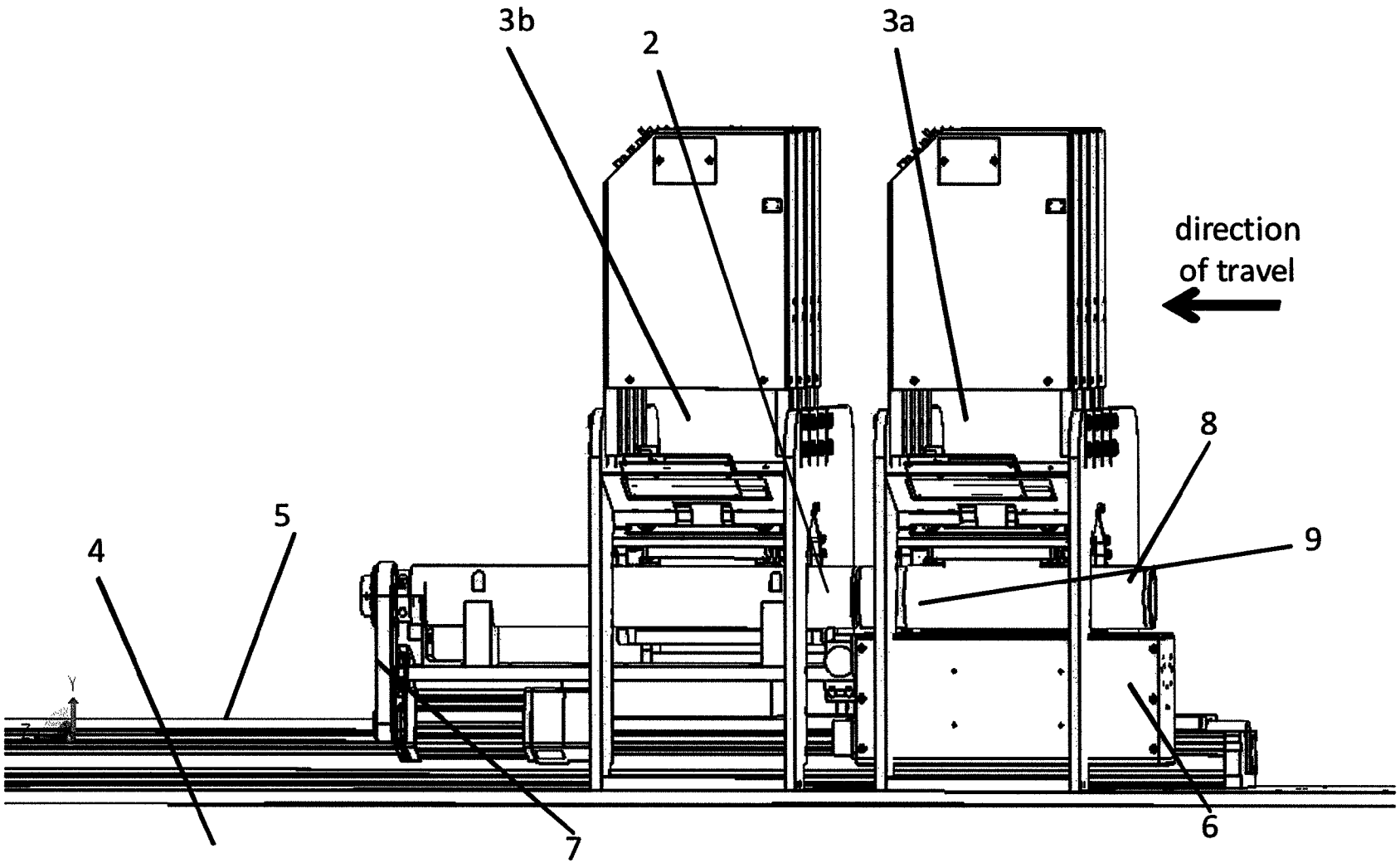
FIG. 5 depicts the carriage assembly axially advanced in a first position.

The carriage assembly 2, includes a mandrel assembly 9 mounted to be aligned along the direction of travel, dimensioned to internally support a hollow cylindrical object to be printed 8. The mandrel assembly 9 is coupled to a rotational drive assembly 7. In this embodiment, the carriage assembly 2 is shown to also include the energy curing assembly 6 mounted to the carriage directly underneath the mandrel assembly 9 such that curing energy (discussed below) is radiated onto the mandrel assembly 9 and specifically onto the hollow cylindrical object to be printed 8 mounted thereon. FIG. 5 depicts the carriage assembly 2 axially and continuously advancing through the first print tunnel 3*a* via the slide actuator 5 such that the hollow cylindrical object to be printed 8 begins to be printed within the first of the print tunnels 3*a*. During printing, the carriage assembly 2 axially and continuously advances while the rotational drive assembly 7 rotates the mandrel assembly 9, onto which the hollow cylindrical object to be printed 8 is mounted. Meanwhile, the energy curing assembly 6 applies energy to the hollow cylindrical object to be printed 8 after printing to either partially cure the print to prevent running of the ink prior to further printing or to completely cure the ink as a finished product if appropriate and desired.

Figure 6:
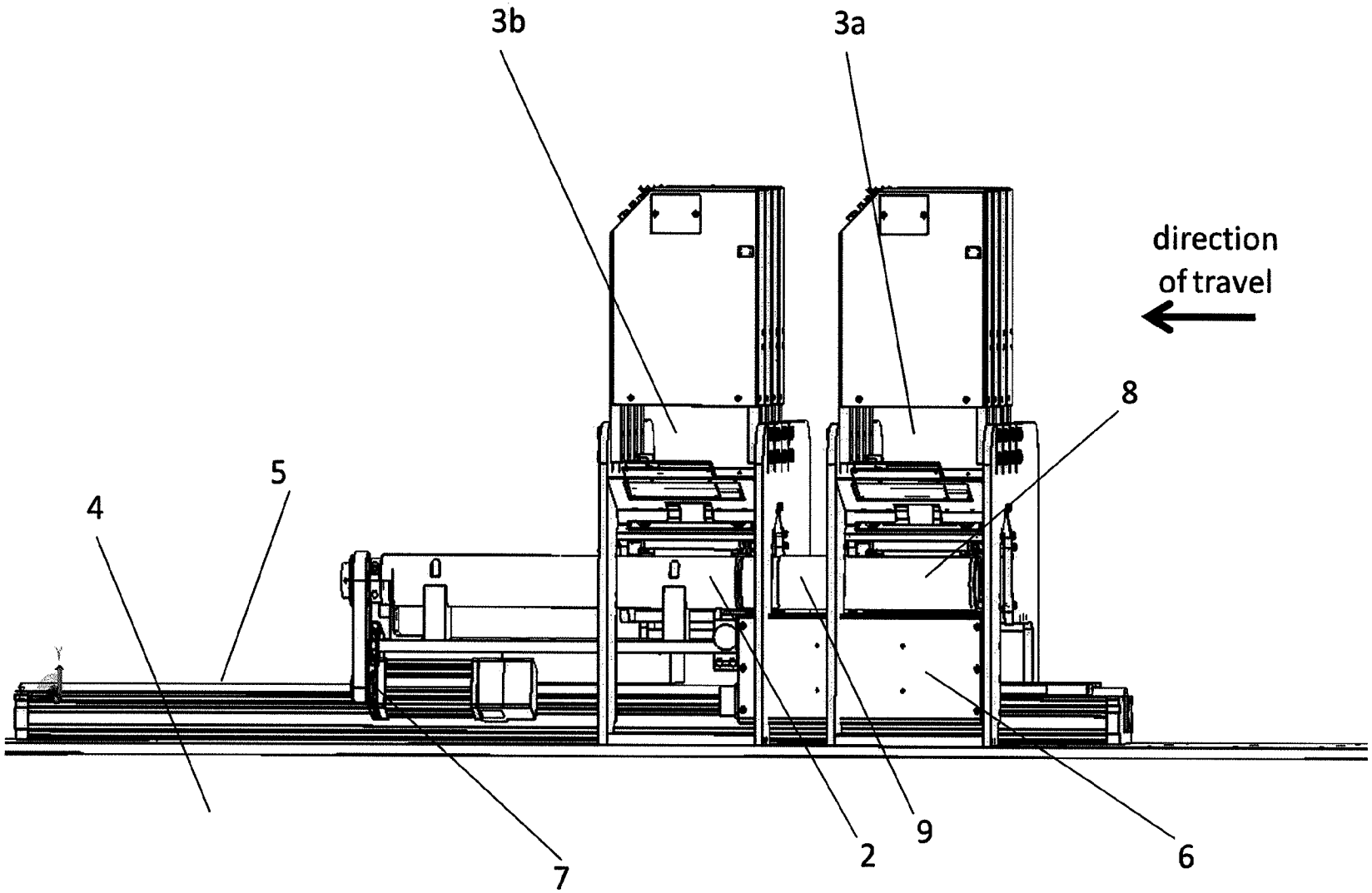
FIG. 6 depicts the carriage assembly further axially advanced in a second position.

FIG. 6 illustrates the carriage assembly 2 further axially advanced by the slide actuator 5 than in FIG. 5 within the first of the print tunnels 3*a*.

Figure 7:
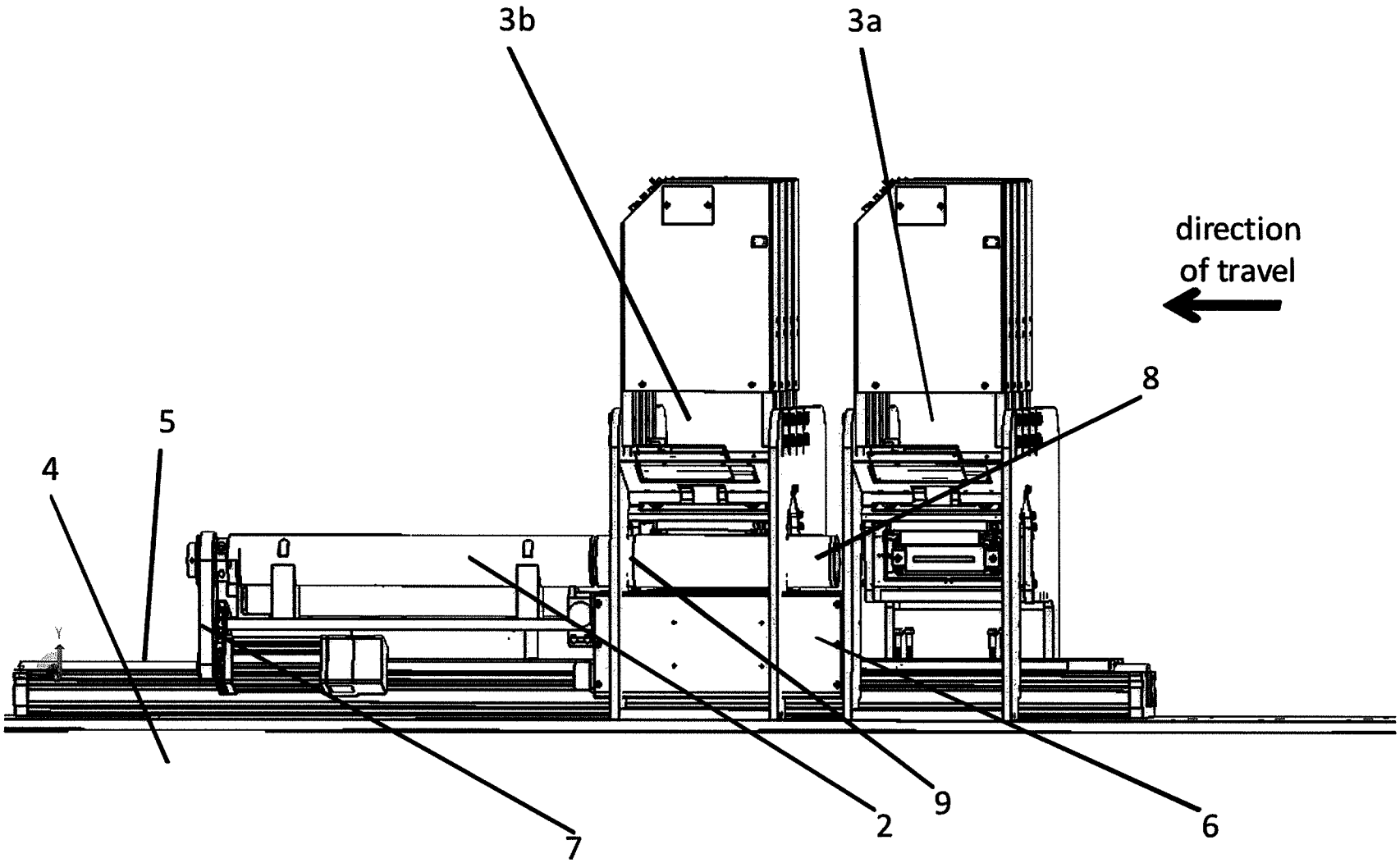
FIG. 7 depicts the carriage assembly further axially advanced in a third position.

FIG. 7 illustrates the carriage assembly 2 slide further axially advanced than in FIG. 6 by the slide actuator 5 such that the hollow cylindrical object to be printed 8 has exited the first print tunnel 3*a* and has entered the second print tunnel 3*b*. The number of print tunnels 3*a*, 3*b* shown here is two, but can be as many as dictated by the number of colors to be printed, as the number of colors in the current embodiment is limited to four per print tunnel 3*a*, 3*b*. Other media besides ink may be printed on the hollow cylindrical object 8 to be printed and may include, but is not limited to, overcoat varnish, size coating, base coating, and any applicable protective or decorative fluid used to enhance the appearance of, or afford protection of, the hollow cylindrical object to be printed 8, and/or to improve adhesion of the ink to be used in its printing.

Figure 8:
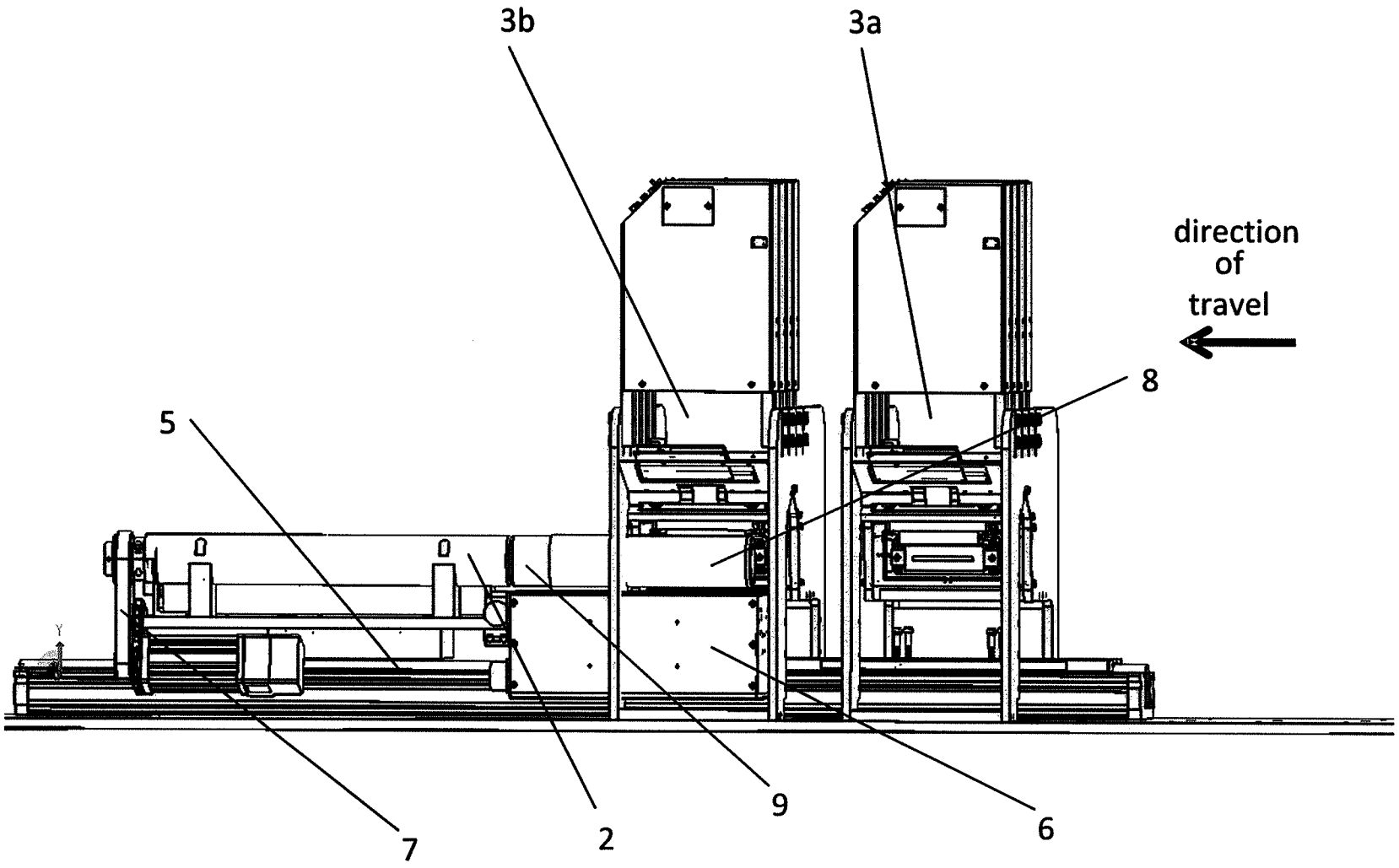
FIG. 8 depicts the carriage assembly further axially advanced in a fourth position.

FIG. 8 illustrates the carriage assembly 2 further axially advanced by the slide actuator 5 than in FIG. 7 within the second of the print tunnels 3*b*.

Figure 9:
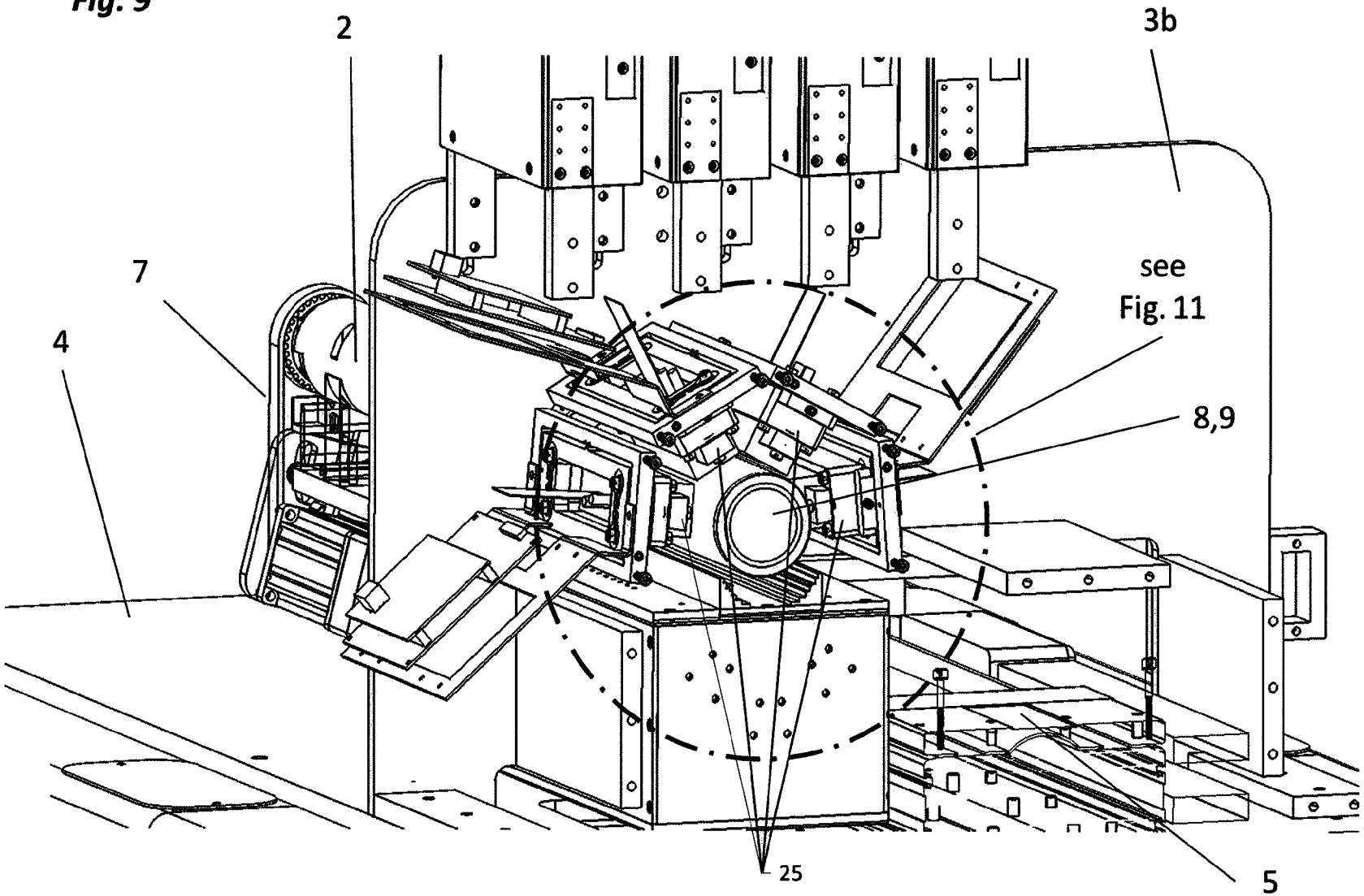
FIG. 9 shows the interconnection of the major components of the invention.

In FIG. 9 is a perspective view of an exemplary print tunnel 3*b* illustrating the interconnection of the major components, namely the slide actuator 5, the carriage assembly 2 connected to the slide actuator 5 and the print tunnel 3*b*. It will be noted that the print tunnel is generally formed by the arch created by the way the printheads 25 are mounted through which ink (or other fluid) is deposited upon the desired hollow cylindrical object to be printed 8.

Figure 10:
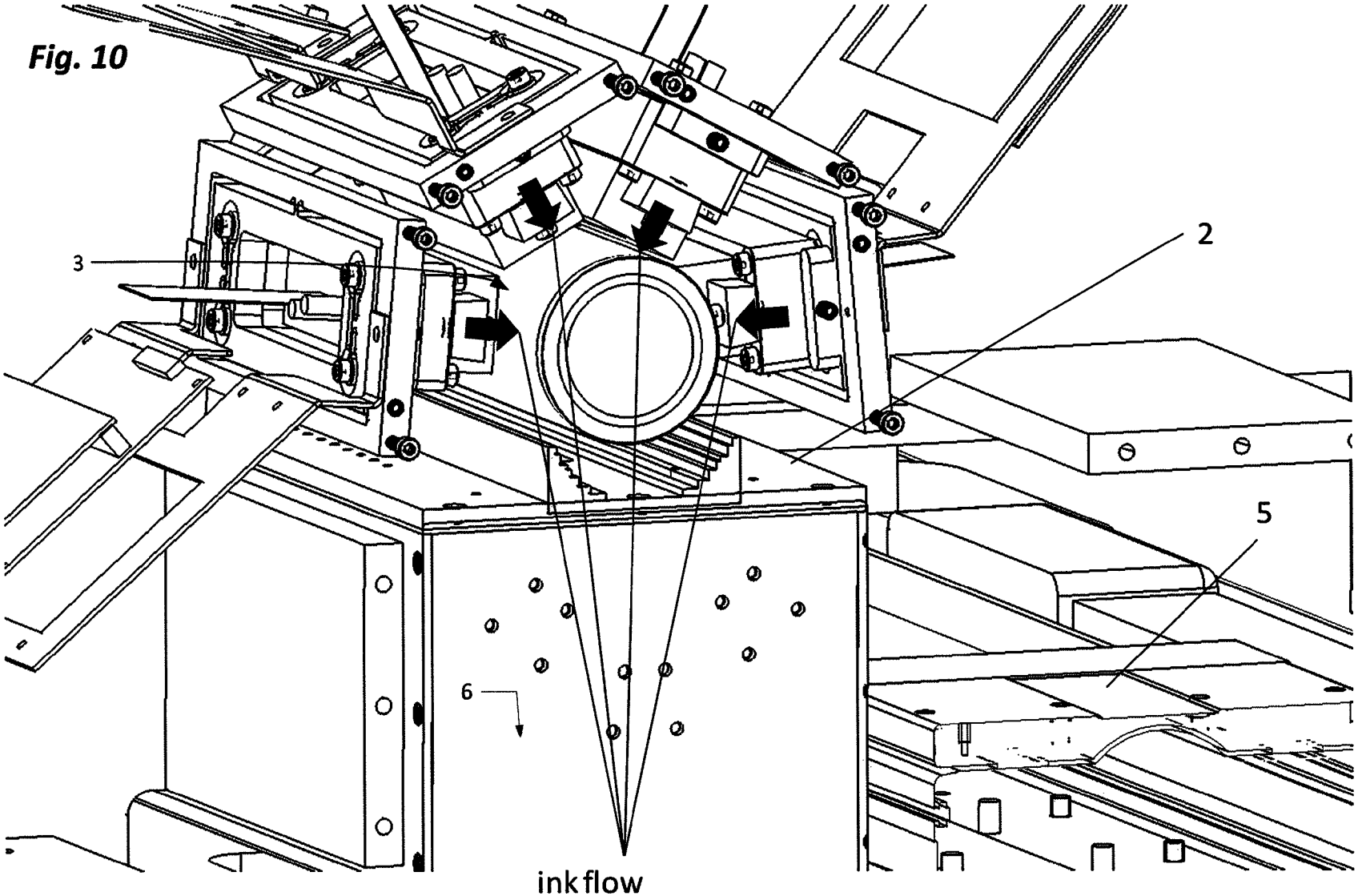
FIG. 10 is a close-up view of the relationship between the major components.
Figure 11:
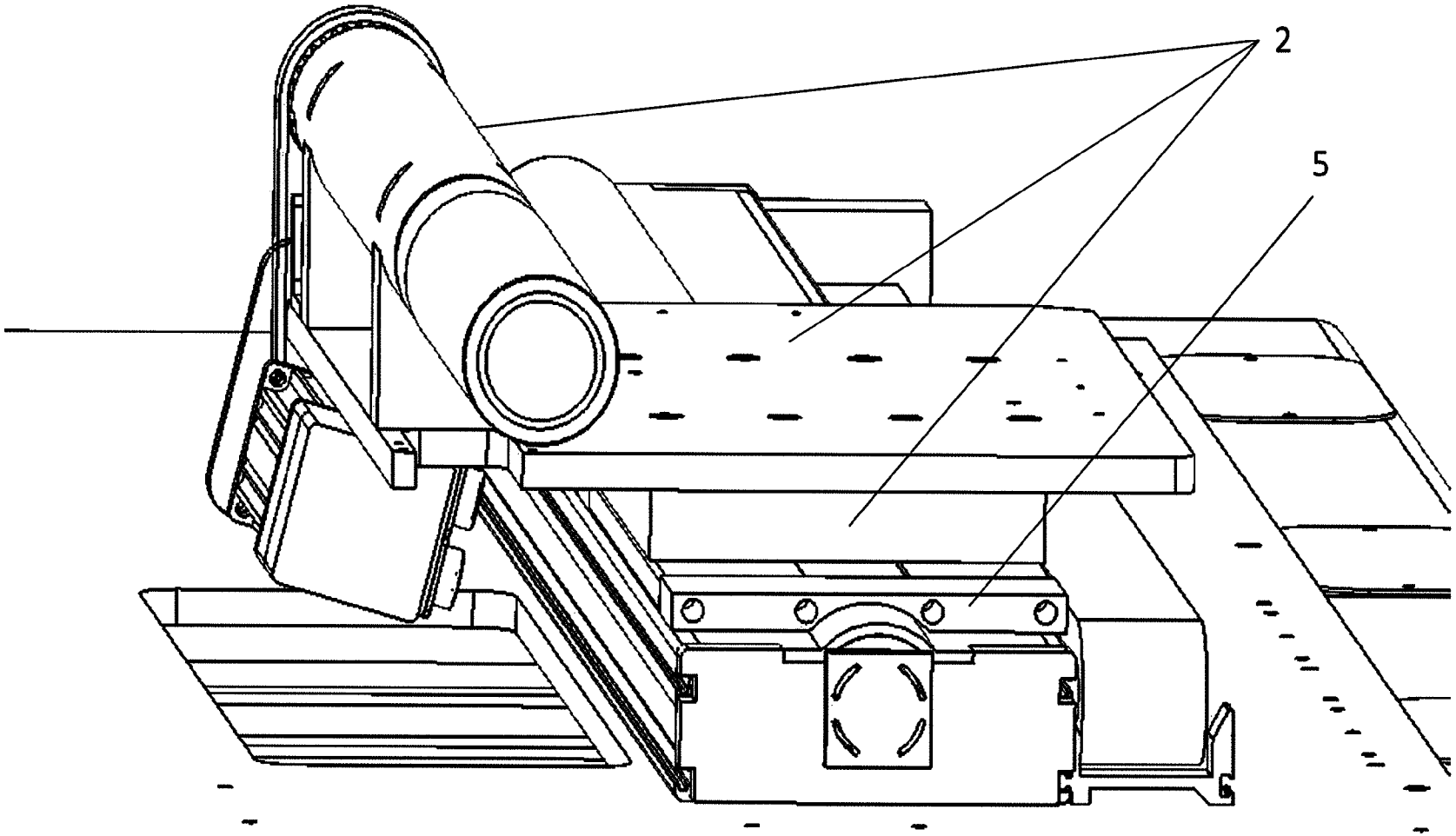
FIG. 11 clarifies the interconnections between the major components.

FIG. 10 also shows the relationship between the major components, namely the slide actuator 5, carriage assembly 2, and print tunnel 3 and energy curing assembly 6. FIG. 11 further clarifies the interconnection between the slide actuator 5 and carriage assembly 2, with the print tunnels 3*a*, 3*b* and energy curing assembly 6 removed for clarity.

Figure 12:
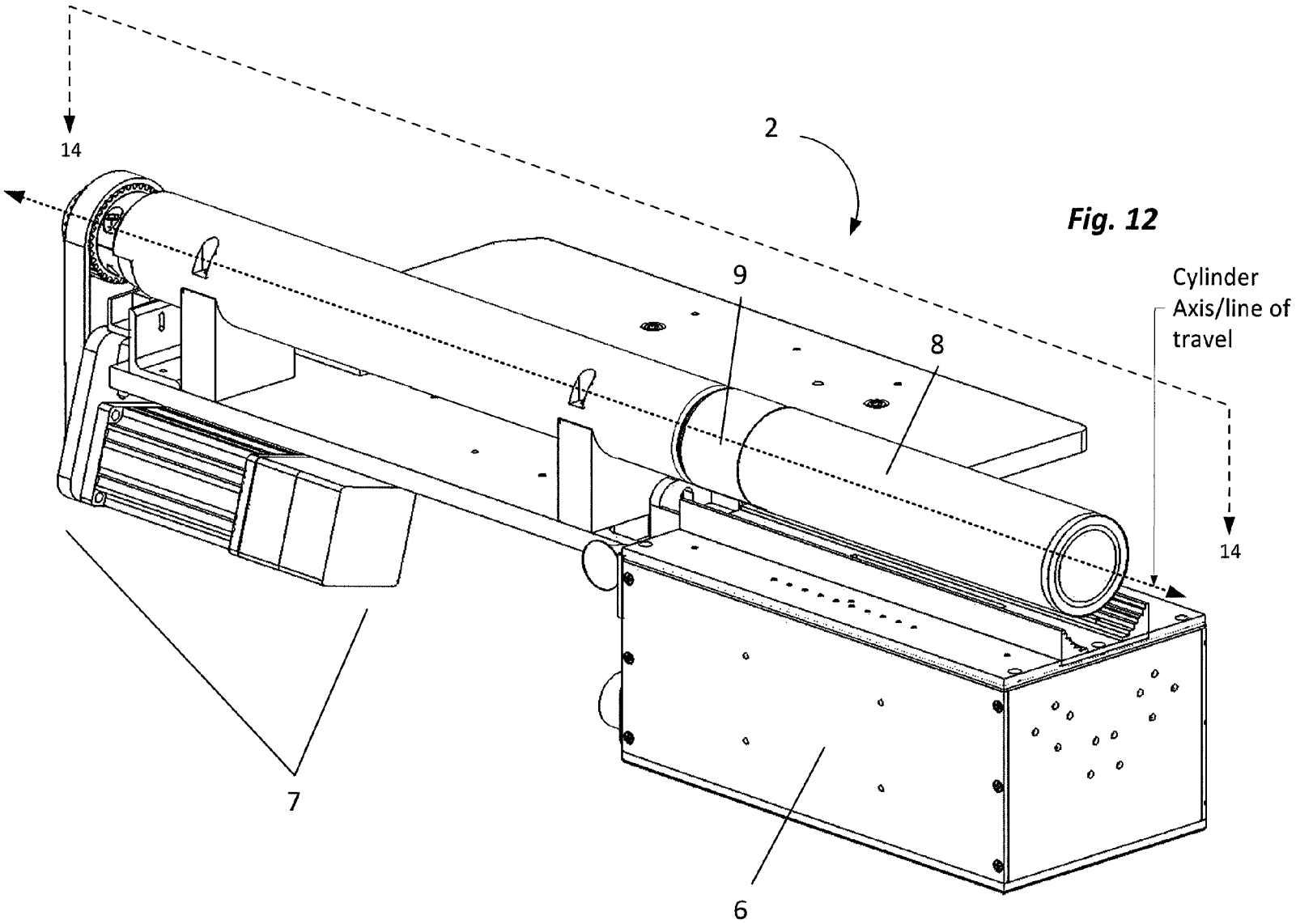
FIG. 12 shows the components of the carriage assembly.
Figure 13:
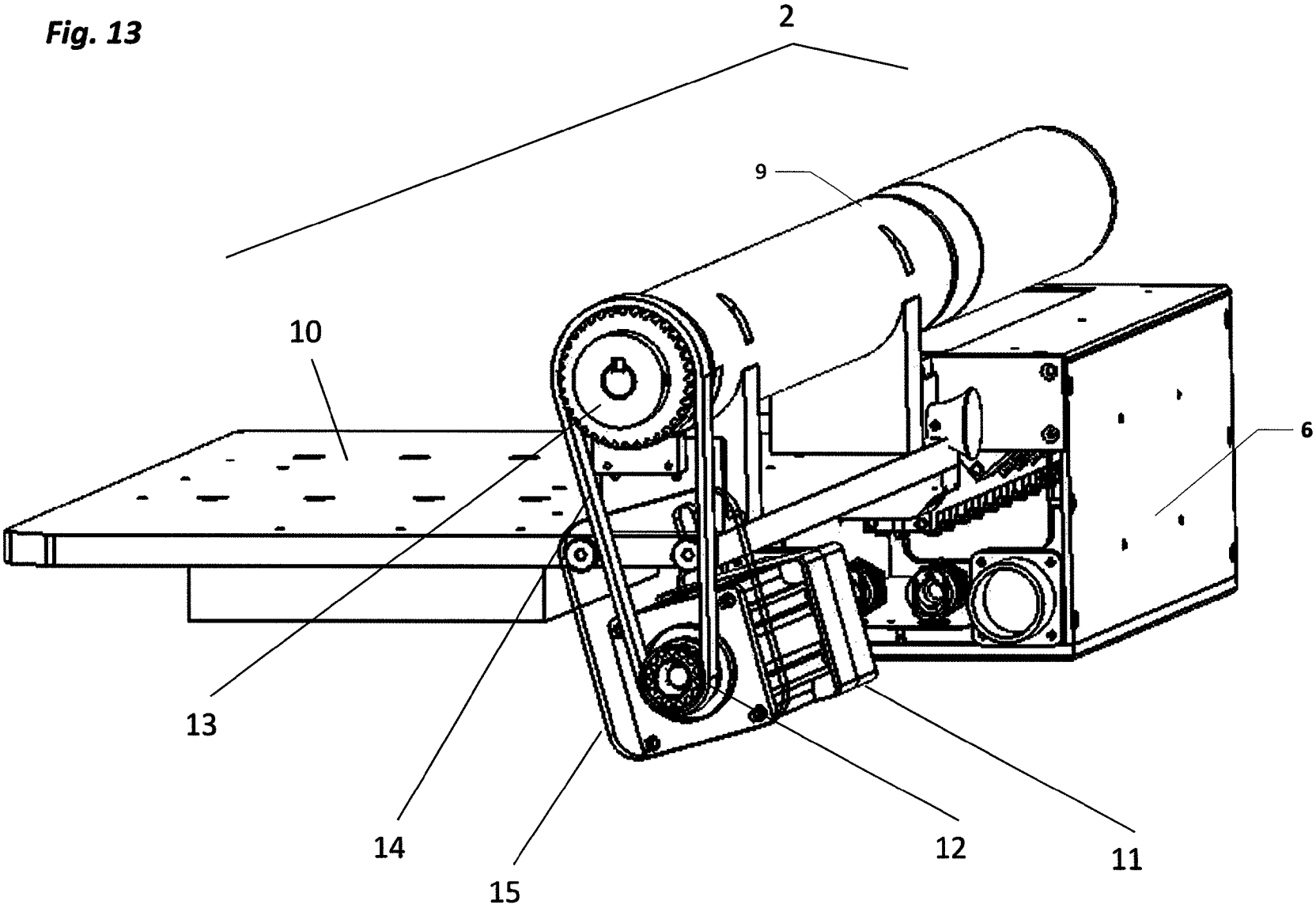
FIG. 13 is a view of the rotary drive end of the carriage assembly.

FIG. 12 shows all the components of the carriage assembly 2, including the rotational drive assembly 7, energy curing assembly 6, and mandrel assembly 9 rotationally coupled to the rotational drive assembly 7, and showing a hollow cylindrical object to be printed 8 mounted thereon. FIG. 13 is a view of the rotary drive end of the carriage assembly 2, namely the carriage mounting plate 10 that supports the mounting of the rotational drive motor 11, the mandrel assembly 9 and the energy curing assembly 6 as shown. A drive pulley 12 is coupled to the motor 11 and is engaged to the driven pulley 13 by a drive belt 14. It can be seen that the motor 11 may be mounted to an optional rotational drive mounting plate 15. The dashed reference line also indicates that the hollow cylindrical object to be printed 8 is held to be axially aligned with the mandrel assembly 9, and such axis is aligned with the line of travel.

Figure 14:
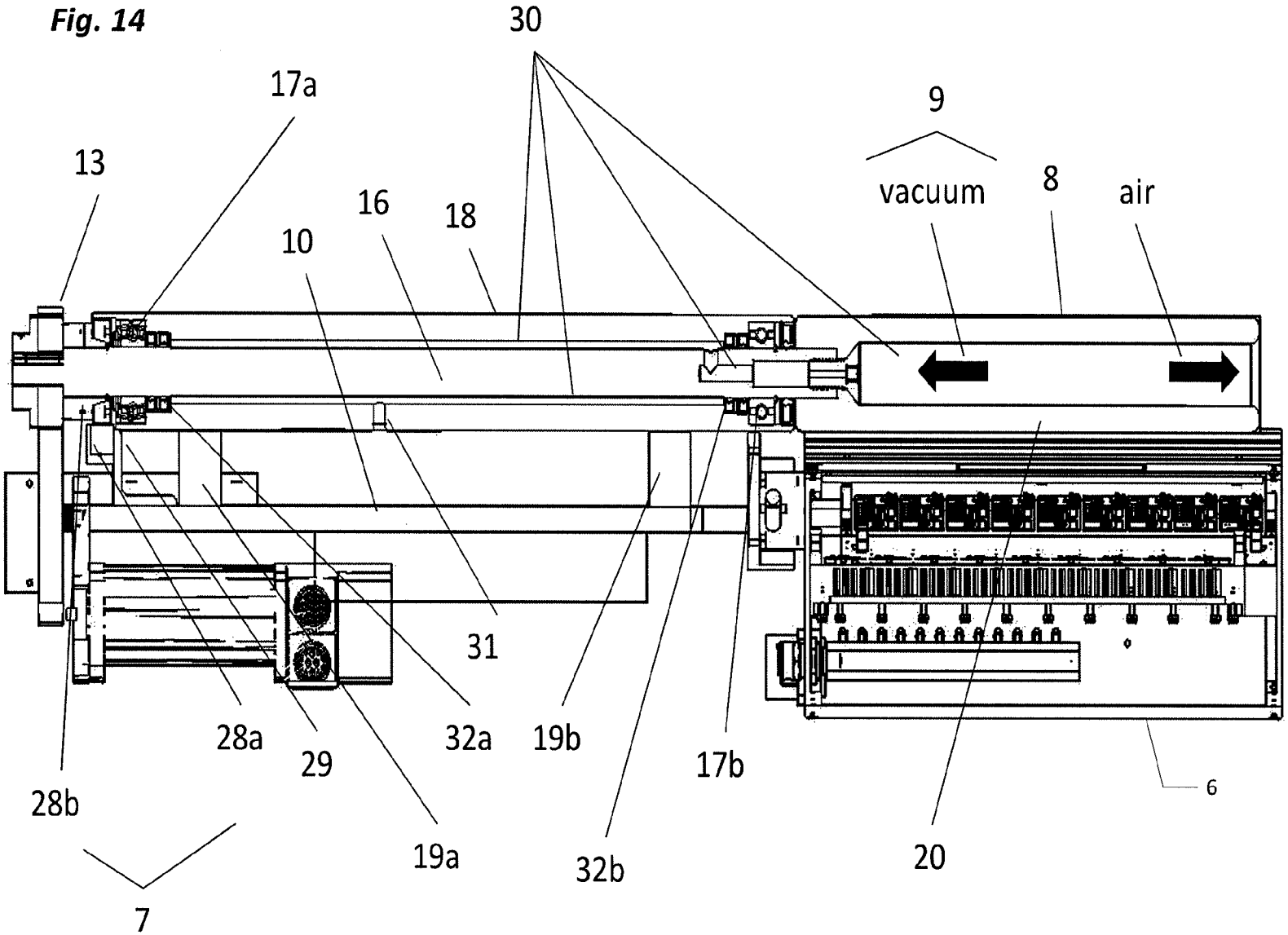
FIG. 14 is a cross-section through the carriage assembly.

FIG. 14 is a cross-section through the carriage assembly 2 as shown in FIG. 12, showing the detail of the mandrel assembly 9 and its interconnection to the driven pulley 13 of the rotational drive assembly 7 via a drive shaft 16. The drive shaft 16 is mounted via bearings 17*a*, 17*b*, which are mounted within a support tube 18, which is in turn mounted to the carriage mounting plate 10 via support blocks 19*a*, 19*b*. The mandrel 20 is connected to the drive shaft 16 and supports the hollow cylindrical object 8 to be printed. The mandrel 20, drive shaft 16, and support tube 18 are constructed and assembled in such a manner as to create a vacuum/air chamber 30 having an opening toward the free end of the mandrel 20 where the hollow cylindrical object to be printed 8 is positioned with an external vacuum/air connection 31 in the sidewall of the support tube 18. Upon loading the hollow cylindrical object to be printed 8 on the mandrel 20, a vacuum is applied via the vacuum/air connection 31, creating a vacuum within the vacuum/air chamber 30 that prevents the hollow cylindrical object to be printed 8 from axially or circumferentially slipping on the mandrel 20 so that the precision of ink deposition to the hollow cylindrical object to be printed 8 is maximized. The air/vacuum chamber 30 is isolated from the atmosphere via seals 32*a*, 32*b*. A first rotational position sensor 28*a* is attached to the carriage mounting plate 10 via a sensor mount 29. A second rotational position sensor 28*b* is directly attached to the drive shaft 16; the first and second rotational position sensors 28*a*, 28*b* are used to control the precise circumferential deposition of ink to the hollow cylindrical object to be printed 8. The vacuum, or at least a low pressure sufficient to draw the cylindrical object against the mandrel, may be created using a conventional air pump coupled to the vacuum/air connection 31, configured to be selectively reversible. When the hollow cylindrical object to be printed 8 has been processed by the apparatus, the pump may be selectively reversed to inject air into the chamber 30, assisting to disengage the hollow cylindrical object to be printed 8 from the mandrel 20.

Figure 15:
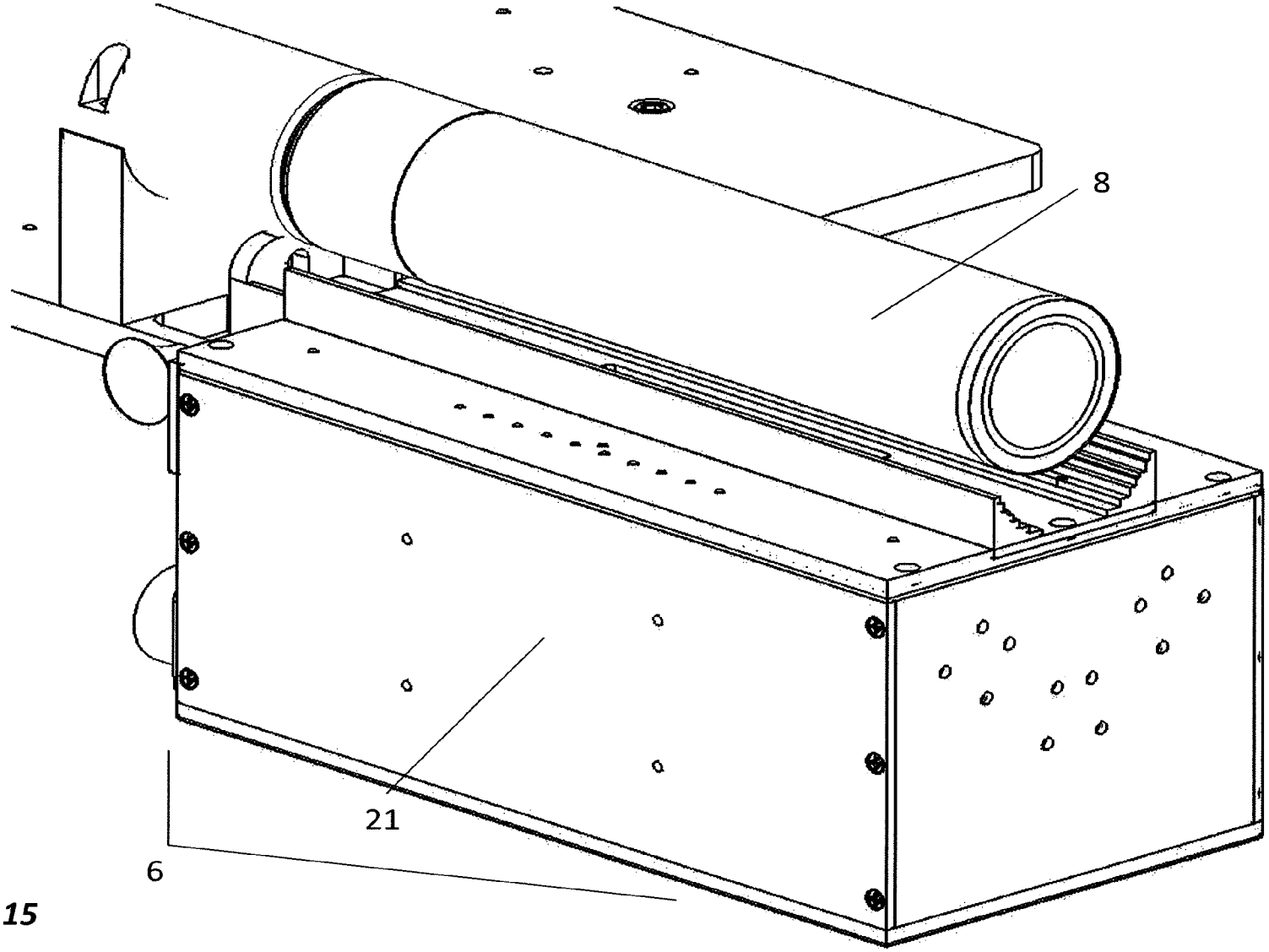
FIG. 15 shows the relationship of the energy curing assembly to the hollow cylindrical object to be printed.
Figure 16:
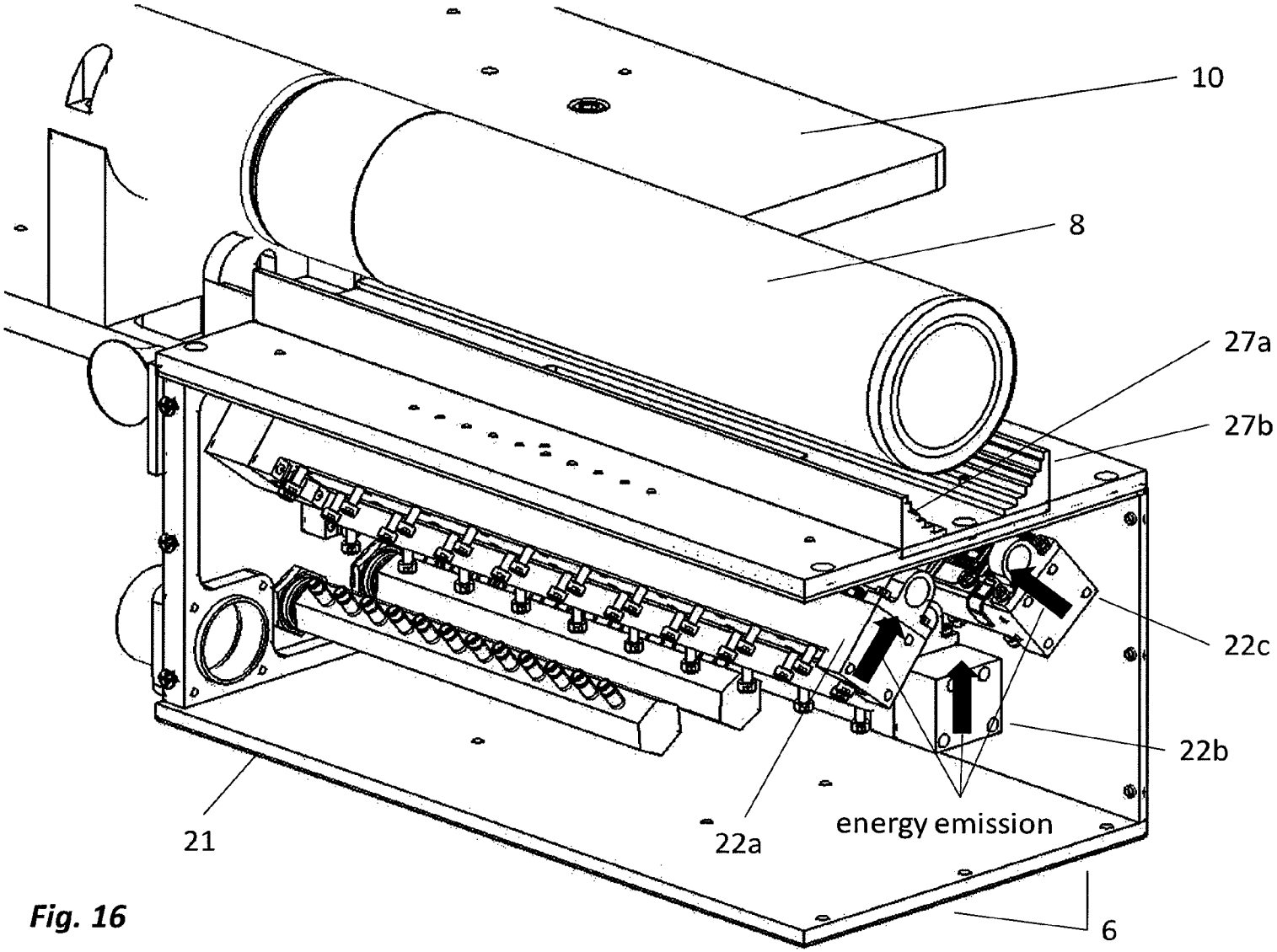
FIG. 16 removes a portion of the energy curing enclosure to more clearly show the energy emitting means.

FIGS. 15 and 16 show the energy curing assembly 6 in detail in relationship to the hollow cylindrical object to be printed 8. The energy curing assembly 6 comprises a housing 21, which contains the energy emitting means 22*a*, 22*b*, 22*c*. Baffles 27*a*, 27*b* mounted on the top surface of the housing 21 may be used to concentrate the energy emission upon the hollow cylindrical object to be printed 8. The energy curing assembly 6 is mounted directly to the carriage mounting plate 10. The term "energy" is understood to include any type of electromagnetic energy suitable for curing of emulsions or resins applied to a substrate including without limitation, ultraviolet. Energy could also include visible light from any suitable source, a non-limiting example being from a light-emitting diode (LED). It will also be understood that energy curing assembly 6 does not need to be mounted to the carriage assembly 2 such that it travels with the hollow cylindrical object to be printed 8 as it is axially indexed through the printing process. Indeed the energy curing assembly 6 may be fixedly mounted at one end of a print tunnel 3 such that when the hollow cylindrical object to be printed 8 is conveyed through the tunnel 3 it is held over the energy curing assembly 6.

Figure 17:
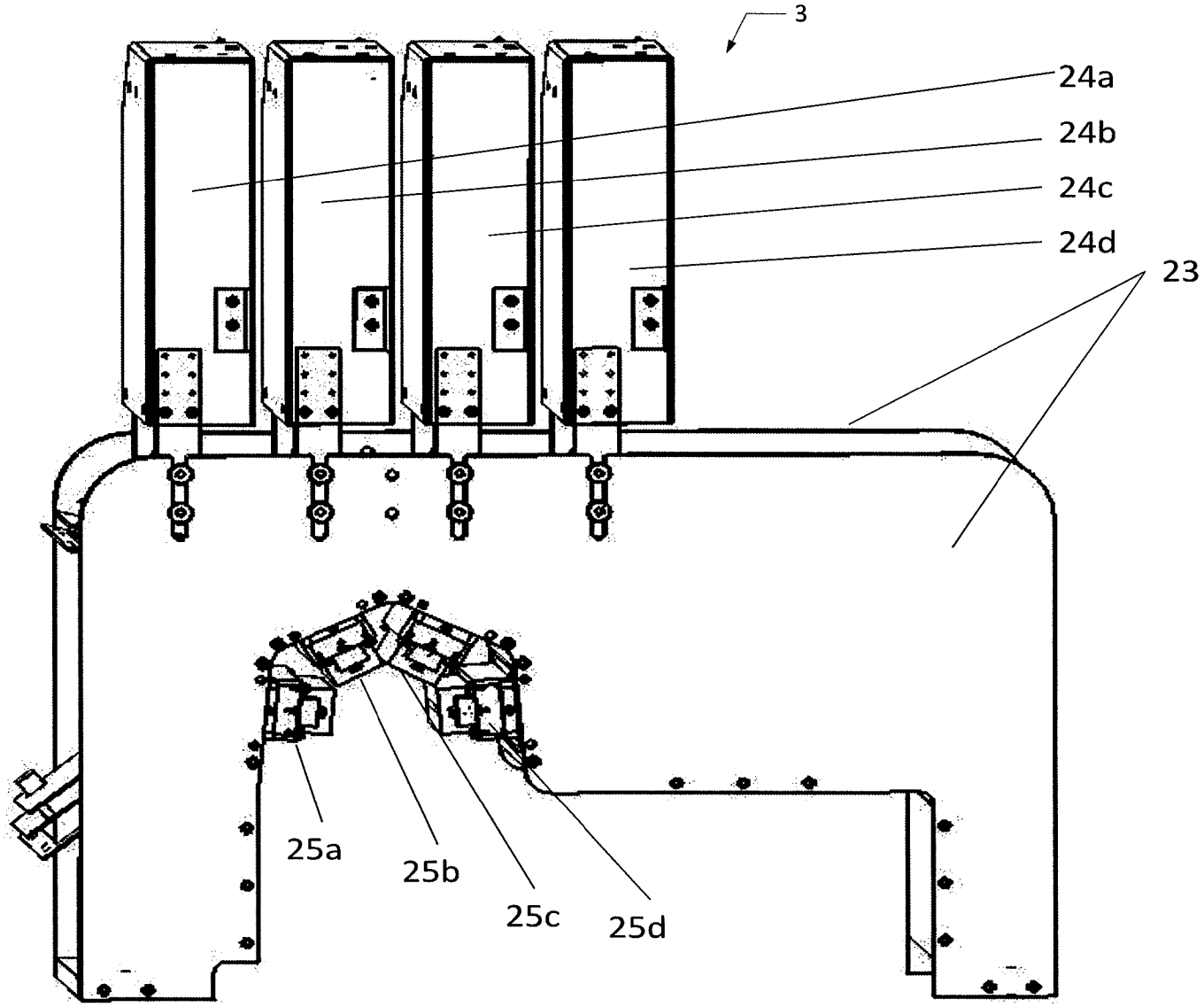
FIG. 17 shows either of the print tunnels in detail.
Figure 18:
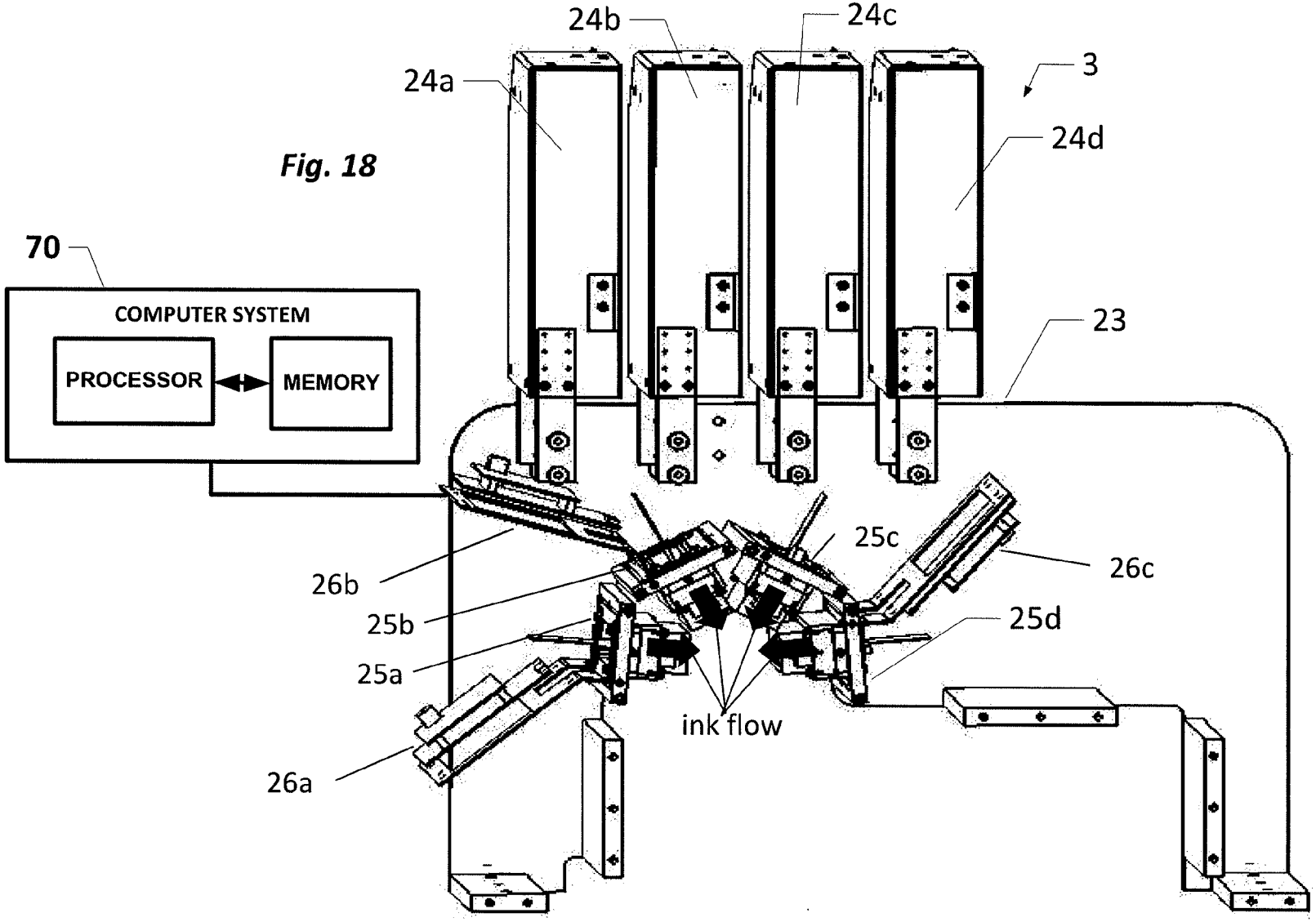
FIG. 18 shows either of the print tunnels with a portion of the print tunnel support removed for clarity.

FIGS. 17 and 18 show an exemplary print tunnel 3 in detail, including the print tunnel support frame 23, ink supply 24*a*, 24*b*, 24*c*, 24*d*, and printheads 25*a*, 25*b*, 25*c*, 25*d*, typically one printhead 25 per color used as would be appreciated by those skilled in the art. Each printhead 25 is controlled through a printed circuit board 26*a*, 26*b*, 26*c* in communication with a computer-based control system 7 (discussed in detail below) that control the deposition of ink that flows from the ink supply 24*a*, 24*b*, 24*c*, 24*d* and onto the hollow cylindrical object 8 to be printed. Printheads 25 are arranged in an arc so that each printhead 25 is the same distance from the surface of the hollow cylindrical object to be printed 8.

Figure 19:
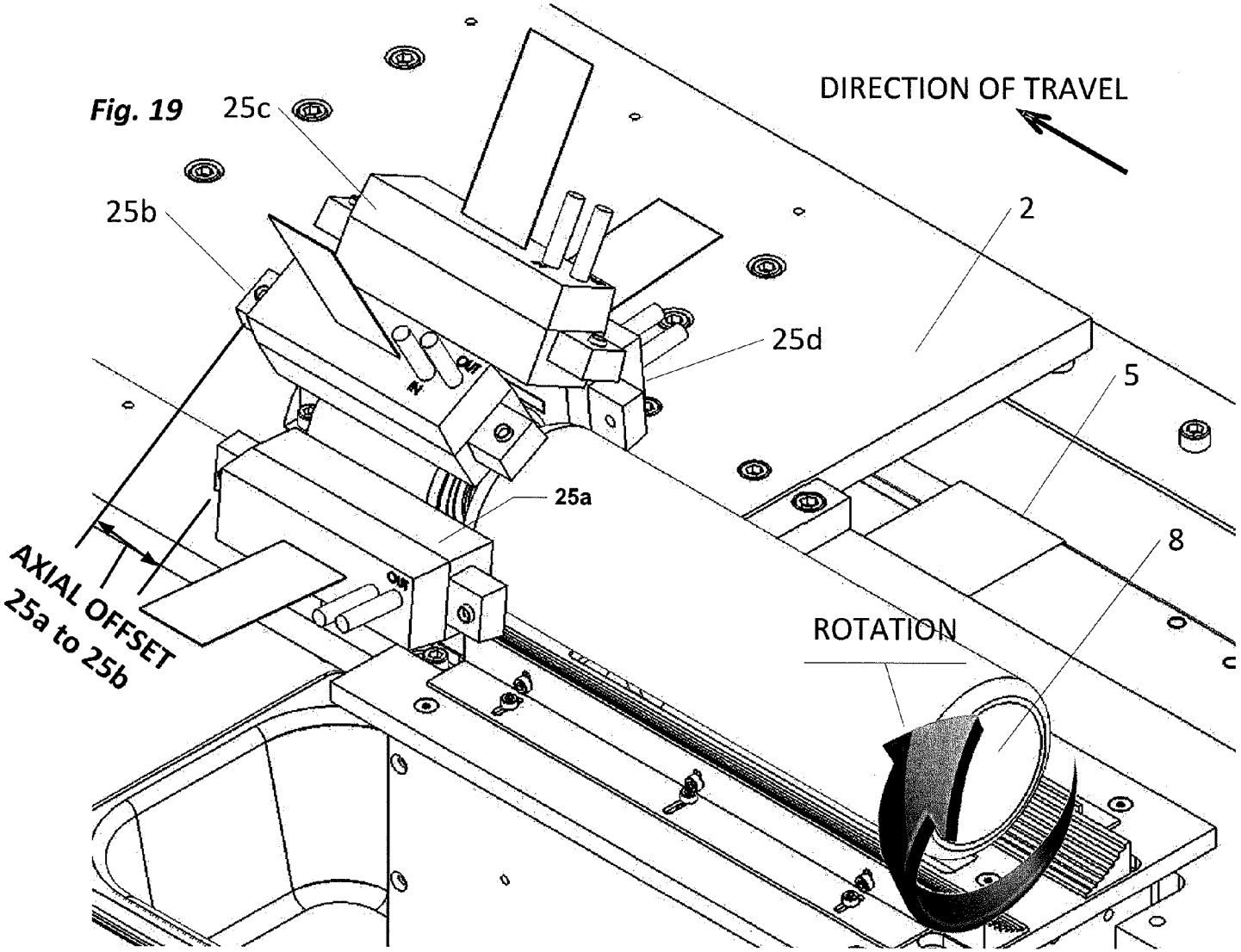
FIG. 19 is a close-up view—with the print tunnels removed for clarity—showing the axial and transverse relationships of the printheads.
Figure 20:
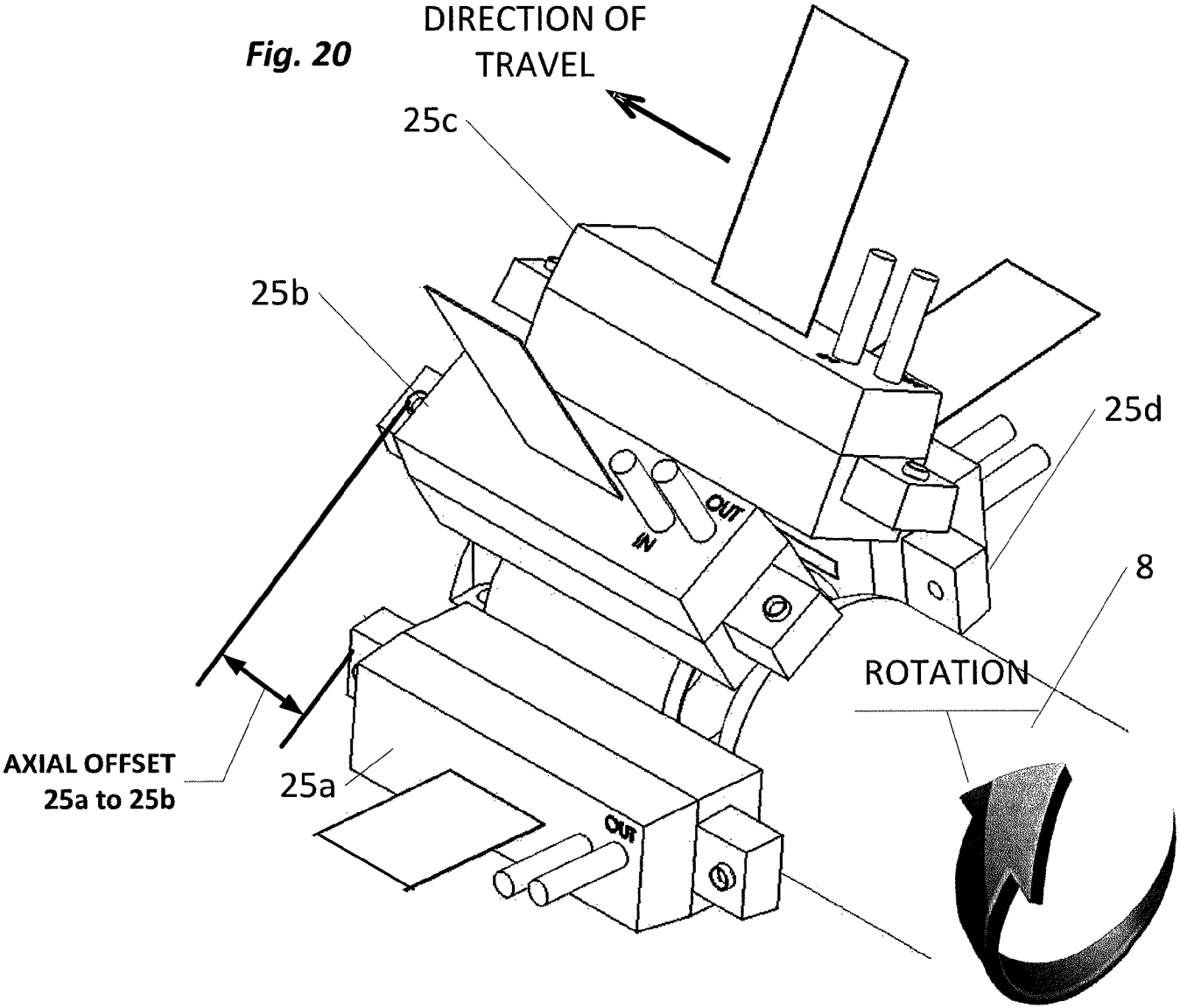
FIG. 20 is a closer view of the printhead arrangement.

FIG. 19 is a close-up view—with the print tunnels 3 removed for clarity—showing the axial and transverse relationships between the printheads 25. FIG. 20 is a closer view of the printhead arrangement, with the hollow cylindrical object to be printed 8 beginning to pass beneath the printheads 25 via axially traversing by means of the slide actuator 5 while simultaneously rotated by the rotational drive assembly 7 (not shown). The axial offset (understood with respect to the Direction of Travel) between printhead 25*a* and 25*b* is highlighted.

Figure 21:
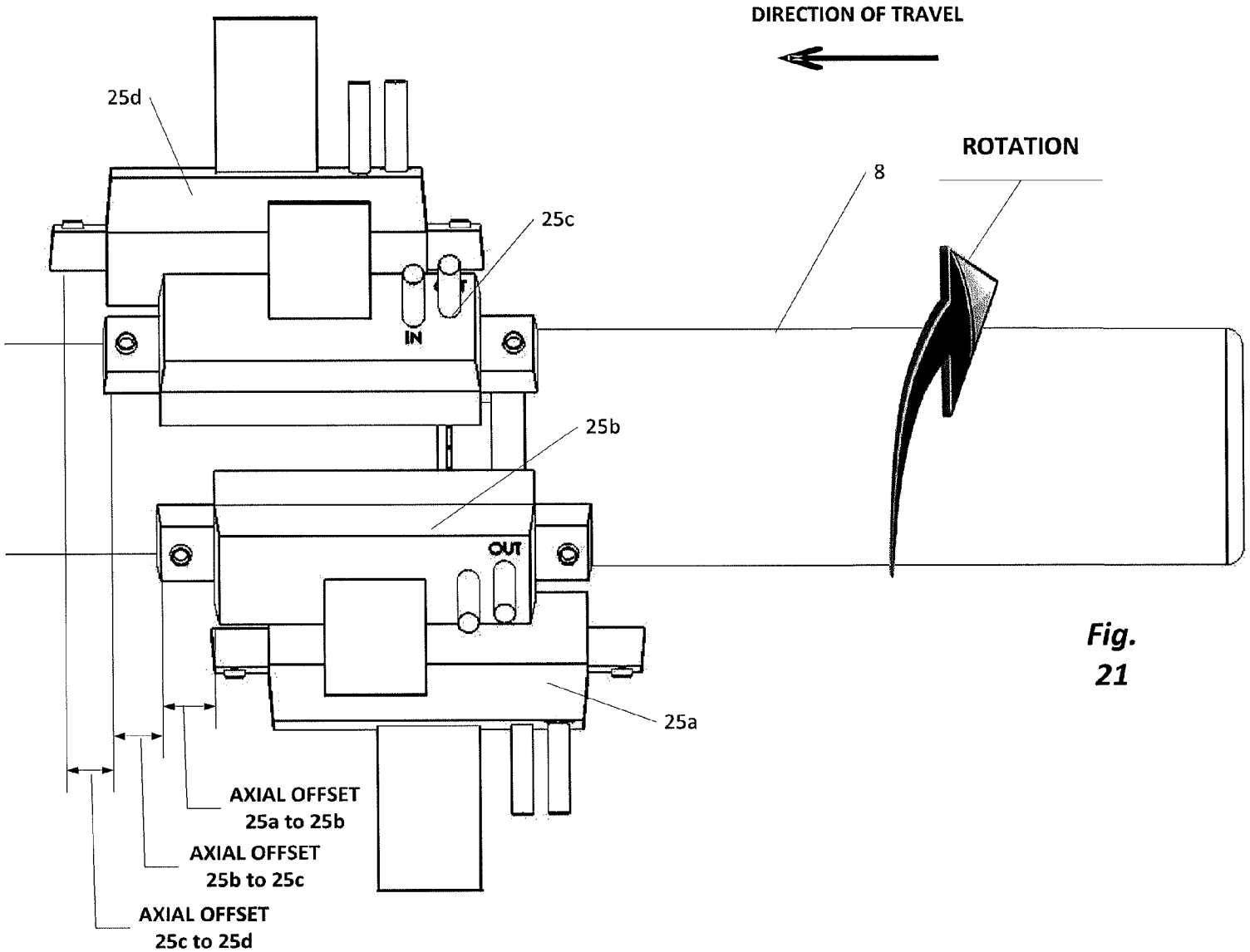
FIG. 21 is top plan view of the hollow cylindrical object to be printed as it begins to be printed.

FIG. 21 is an elevation view of the hollow cylindrical object to be printed 8 as it begins to be printed by printhead 25*a* during simultaneous and continuous axial and rotary motion. Highlighted here as well is the axial offset between printheads 25*a* and 25*b*, 25*b* and 25*c*, and 25*c* and 25*d*. The degree or amount of axial offset is variable and not necessarily equal between each printhead 25 and not necessary equal for each print tunnel 3. The printheads 25 may jet ink at separate times or simultaneously, depending upon the desired print design and resolution, hollow cylindrical object to be printed 8 diameter and length, printhead 25 length and deposition rate, desired ink density, as well as axial displacement of the printheads 25 to achieve the desired results.

Figure 22:
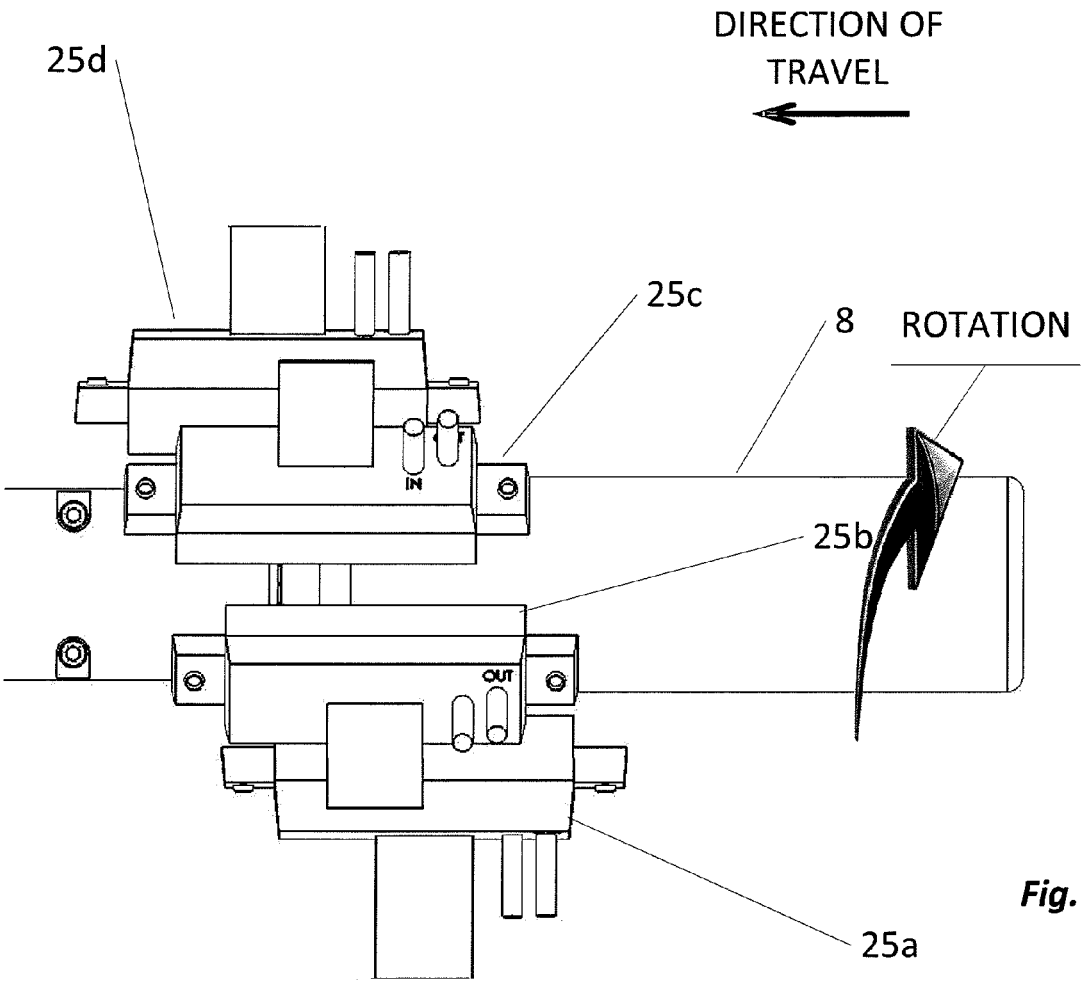
FIG. 22 shows the hollow cylindrical object to be printed further axially advanced vis-à-vis FIG. 21.

FIG. 22 shows the hollow cylindrical object to be printed 8 further axially advanced in such proximity that—in this illustration—the hollow cylindrical object to be printed 8 is in such a position that all four printheads 25 are able to jet ink to it during its simultaneous and continuous axial and rotational motion.

Figure 23:
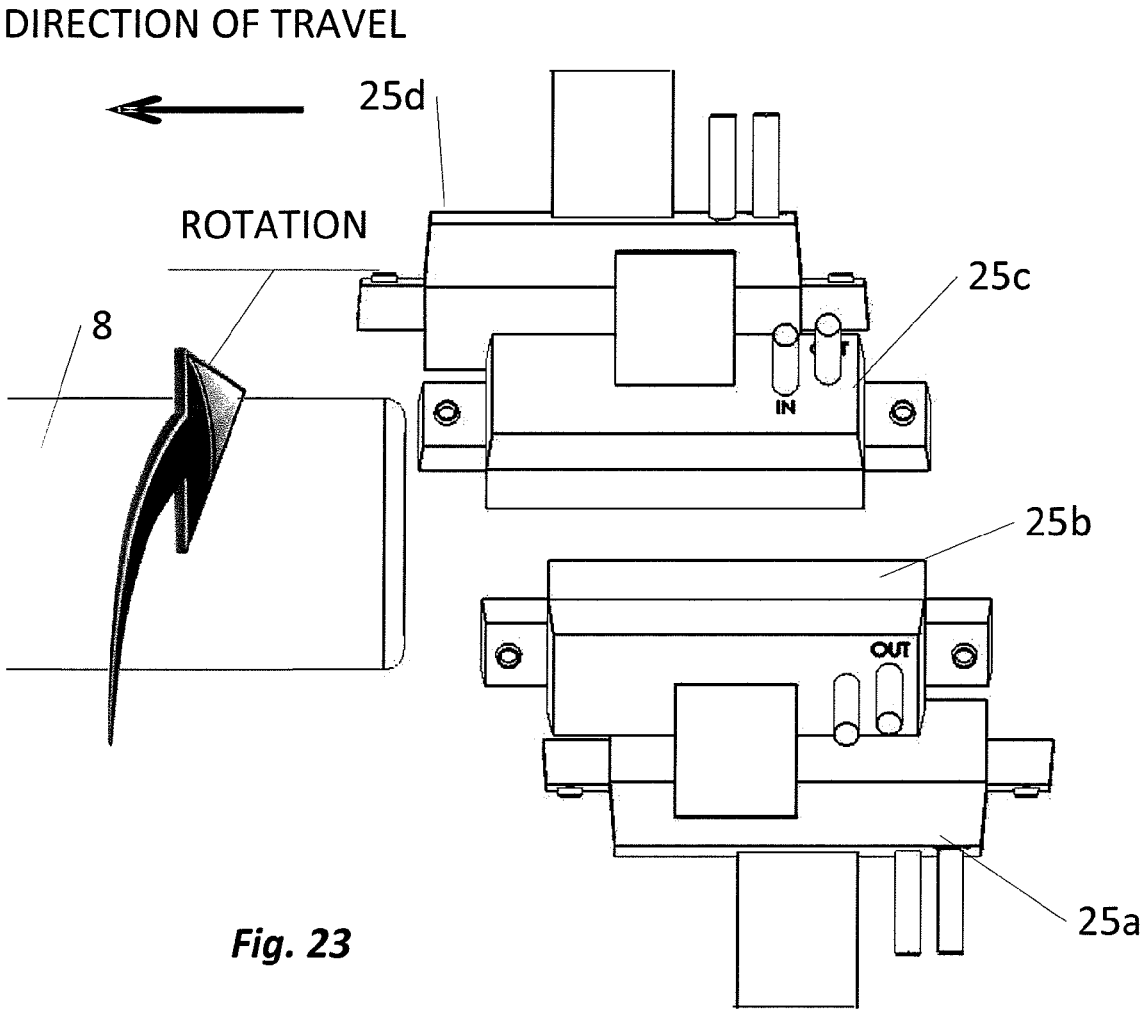
FIG. 23 shows the hollow cylindrical object to be printed 8 continuing to axially traverse vis-à-vis FIG. 22.

FIG. 23 shows the hollow cylindrical object to be printed 8 continuing to axially traverse such that it has cleared the printheads 25 and is ready to enter the next print tunnel(s) 3, if applicable, or return back to the end of the invention where it was originally loaded, at which point it may be removed and the next hollow cylindrical object to be printed 8 loaded onto the mandrel assembly 9 for printing. The hollow cylindrical object to be printed 8 may be hand-loaded/unloaded or mechanically loaded/unloaded via automation, utilizing structures and controls already known in the art.

Figure 24:
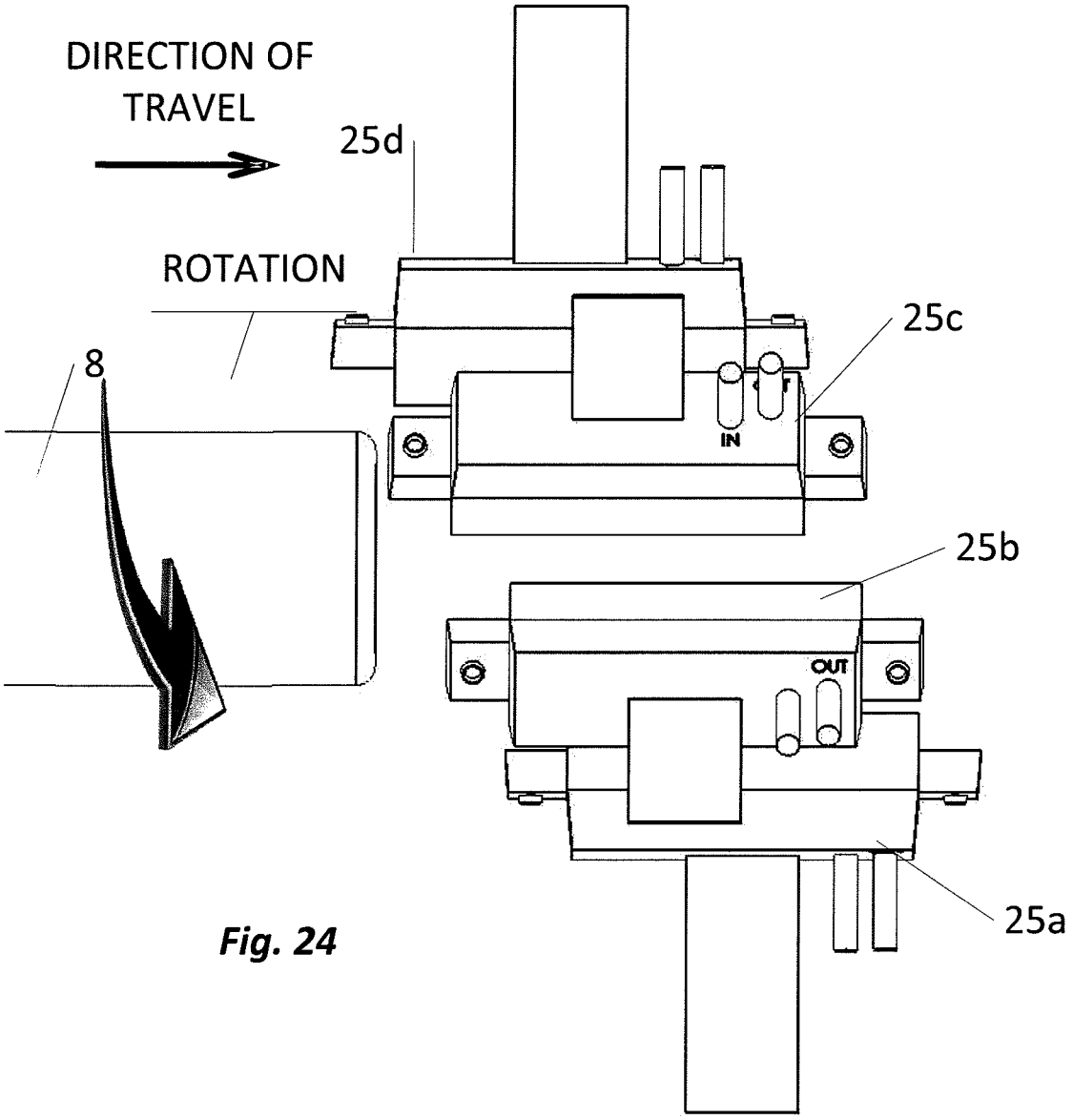
FIG. 24 shows the hollow cylindrical object to be printed axially reversing after the first, single-direction pass through the print tunnel(s)

In an alternative operation of this first embodiment, the carriage assembly 2 is commanded to reverse direction after the first, single-direction pass through the print tunnel(s) 3—as shown in FIG. 24—while simultaneously rotating so that during such return motion printing may continue, with the printheads 25 jetting ink in the reverse order from the first pass beneath them. The necessity to continue to print in this manner will be dictated by the desired print design and resolution, hollow cylindrical object to be printed 8 diameter and length, printhead 25 length and deposition rate, desired ink density, as well as axial displacement of the printheads 25 to achieve the desired results.

Figure 25:
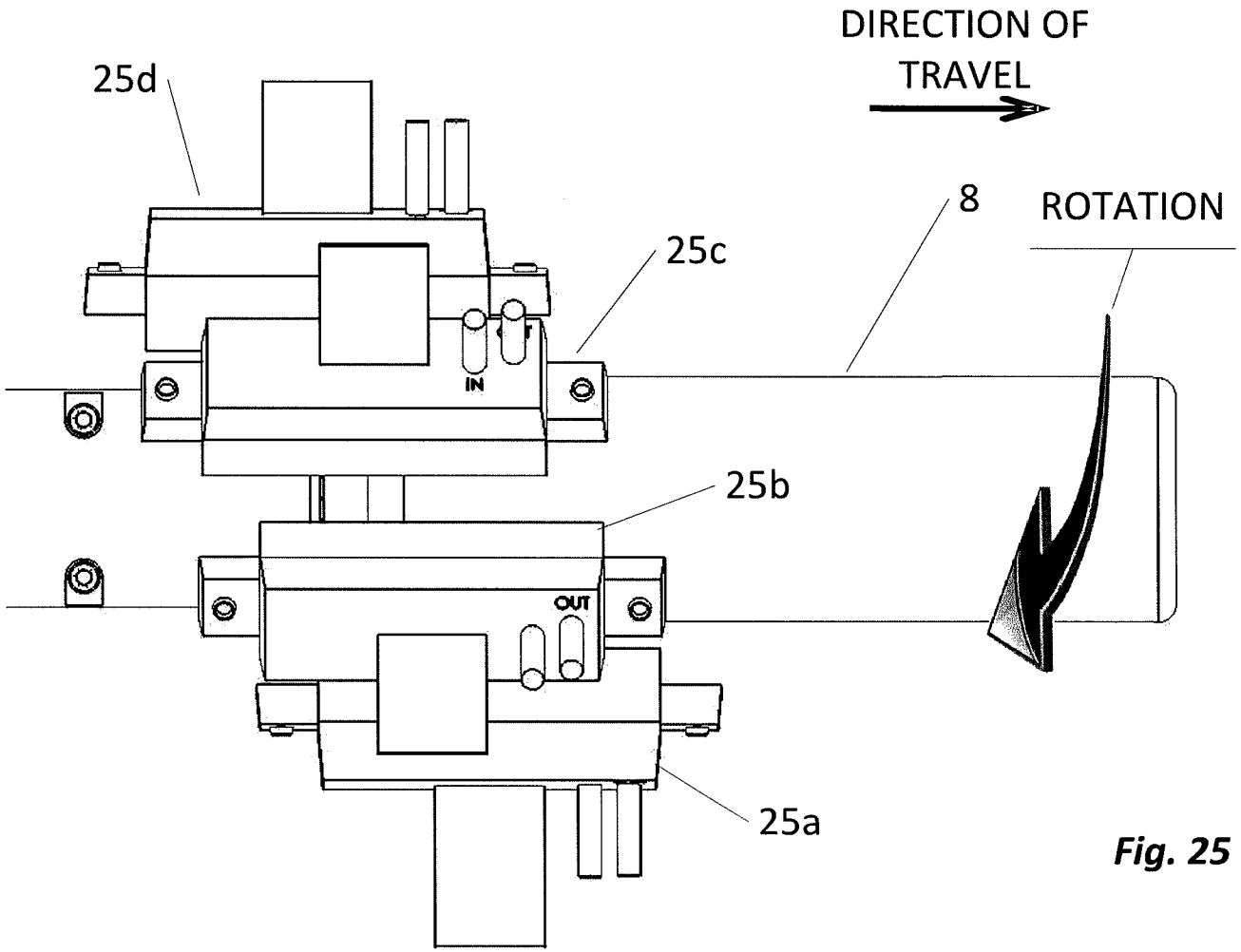
FIG. 25 illustrates the hollow cylindrical object to be printed traversing back toward the end of the invention at which it was originally loaded while the printheads jet ink.

FIG. 25 illustrates the hollow cylindrical object to be printed 8 traversing back toward the end of the invention at which it was originally loaded, during continuous and simultaneous linear—or axial—and rotary motion while the printheads 25 jet ink as necessary to complete the printing of the intended design. After passing within the requisite print tunnels(s) 3 to complete the design, the hollow cylindrical object to be printed 8 may either traverse back to the original loading position to be removed or may reverse direction once again—as shown in FIG. 21—to be printed again, the number of repetitions dictated by the desired print design and resolution, hollow cylindrical object to be printed 8 diameter and length, printhead 25 length and deposition rate, desired ink density, as well as axial displacement of the printheads 25 to achieve the desired results.

Figure 26:
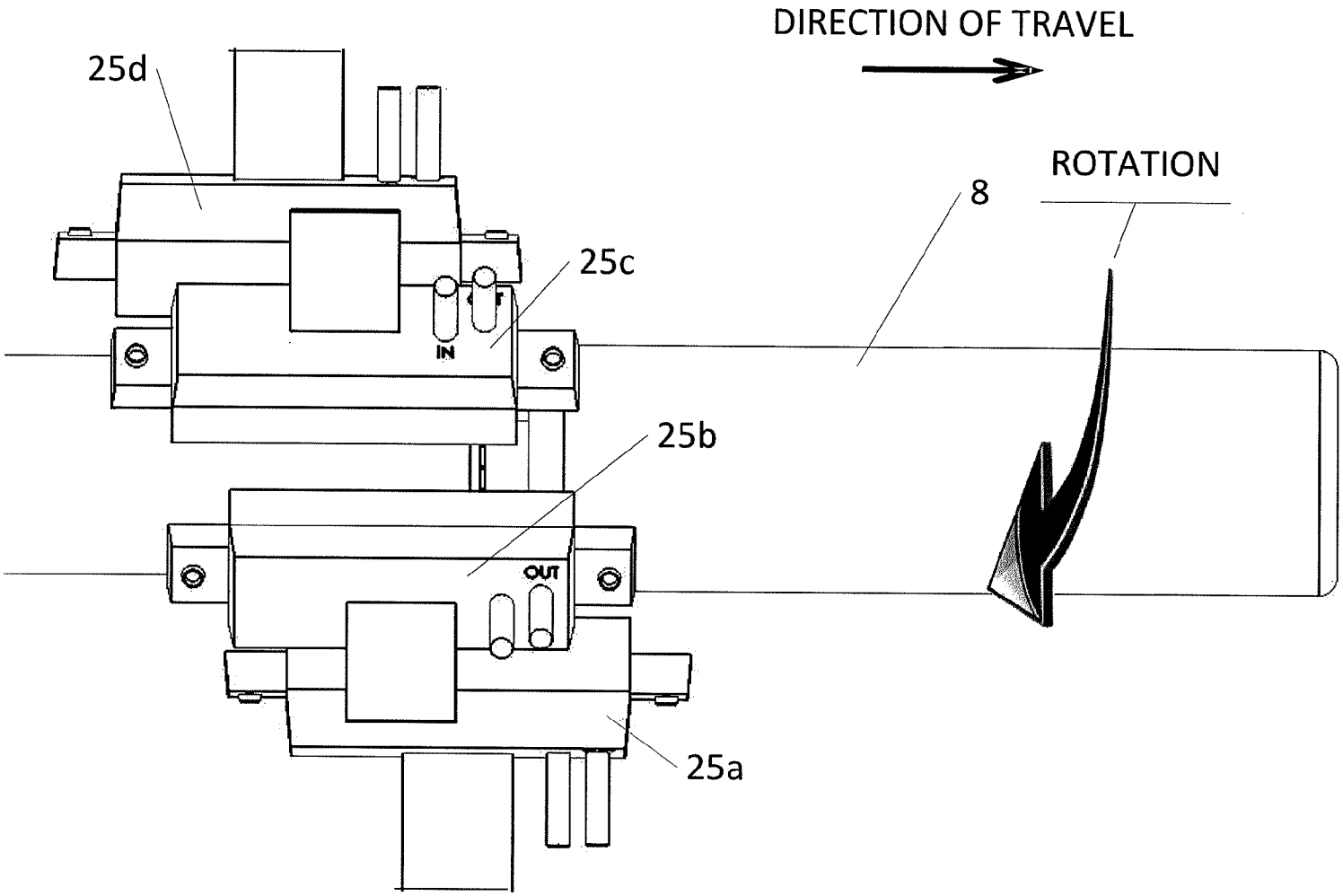
FIG. 26 illustrates the hollow cylindrical object to be printed nearing the end of its reverse (or second) pass through the print tunnel(s)

FIG. 26 illustrates the hollow cylindrical object to be printed 8 nearing the end of its reverse (or second) pass through the print tunnel(s) 3; it is at this point illustrated as being only beneath printhead 25*a*. When carriage assembly 2 conveying the object 8 returns back to the end of the track where it was originally loaded, after all printing passes have been accomplished, it may be removed and the next hollow cylindrical object to be printed 8 loaded onto the mandrel assembly 9 for printing. The hollow cylindrical object to be printed 8 may be hand-loaded/unloaded or mechanically loaded/unloaded via automation, utilizing structures and controls already known in the art.

Figure 27:
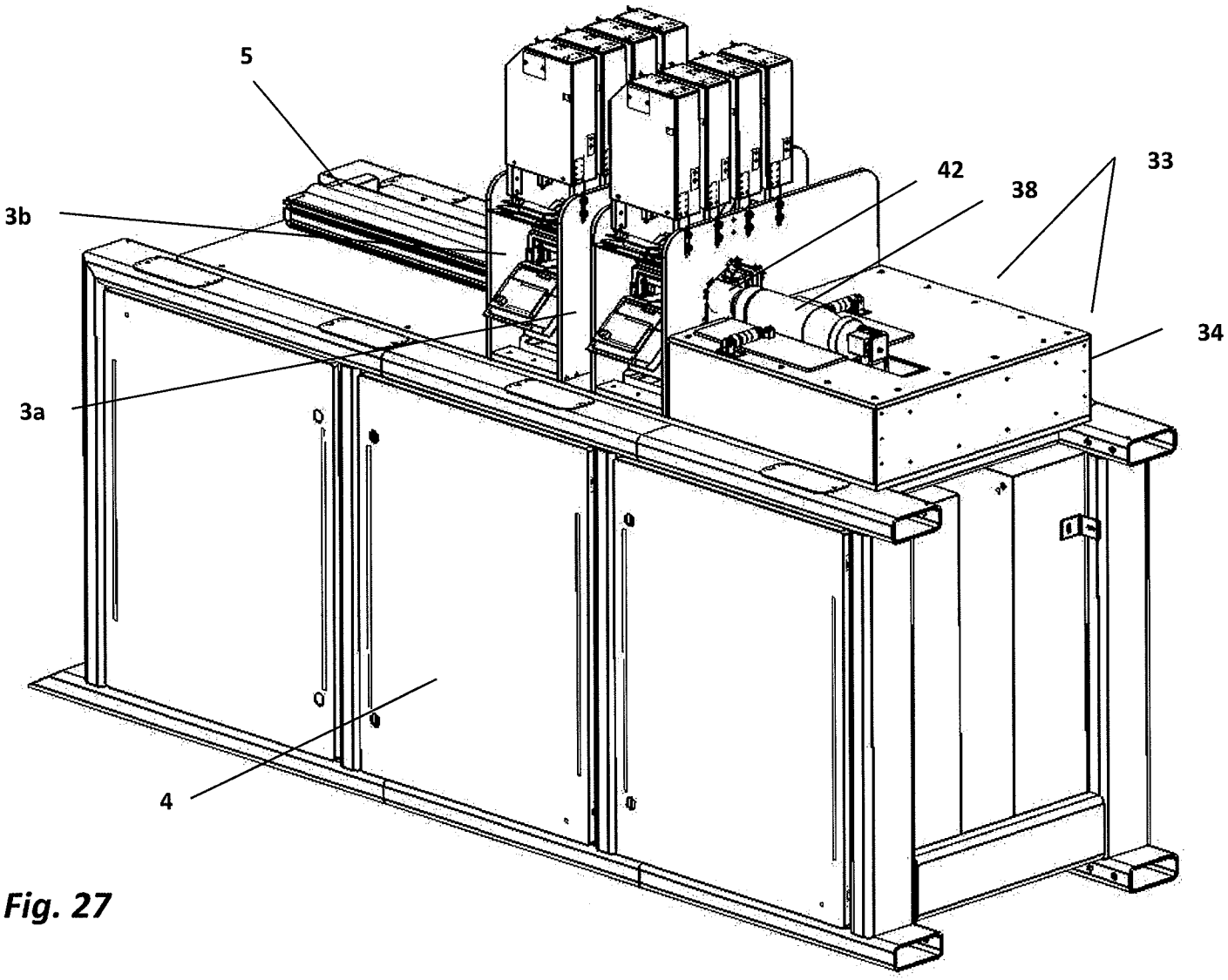
FIG. 27 shows a second exemplary embodiment of a printing apparatus.

A second exemplary embodiment of a printing apparatus is shown in FIG. 27 which depicts a digital printing apparatus for decorating hollow partially-cylindrical objects to be printed (or bottles) 38. This version comprises four main, interconnected components: carriage assembly 42, print tunnels 3*a*, 3*b*, support frame 4, and slide actuator 5. The slide actuator 5 and print tunnels 3*a*, 3*b* are both connected directly to the mounting frame 4. The carriage assembly 42 is in turn mounted directly to the slide actuator 5. In this embodiment there exists also an object-centering assembly 33, which attaches directly to the mounting frame 4 via the object-centering support 34.

Figure 28:
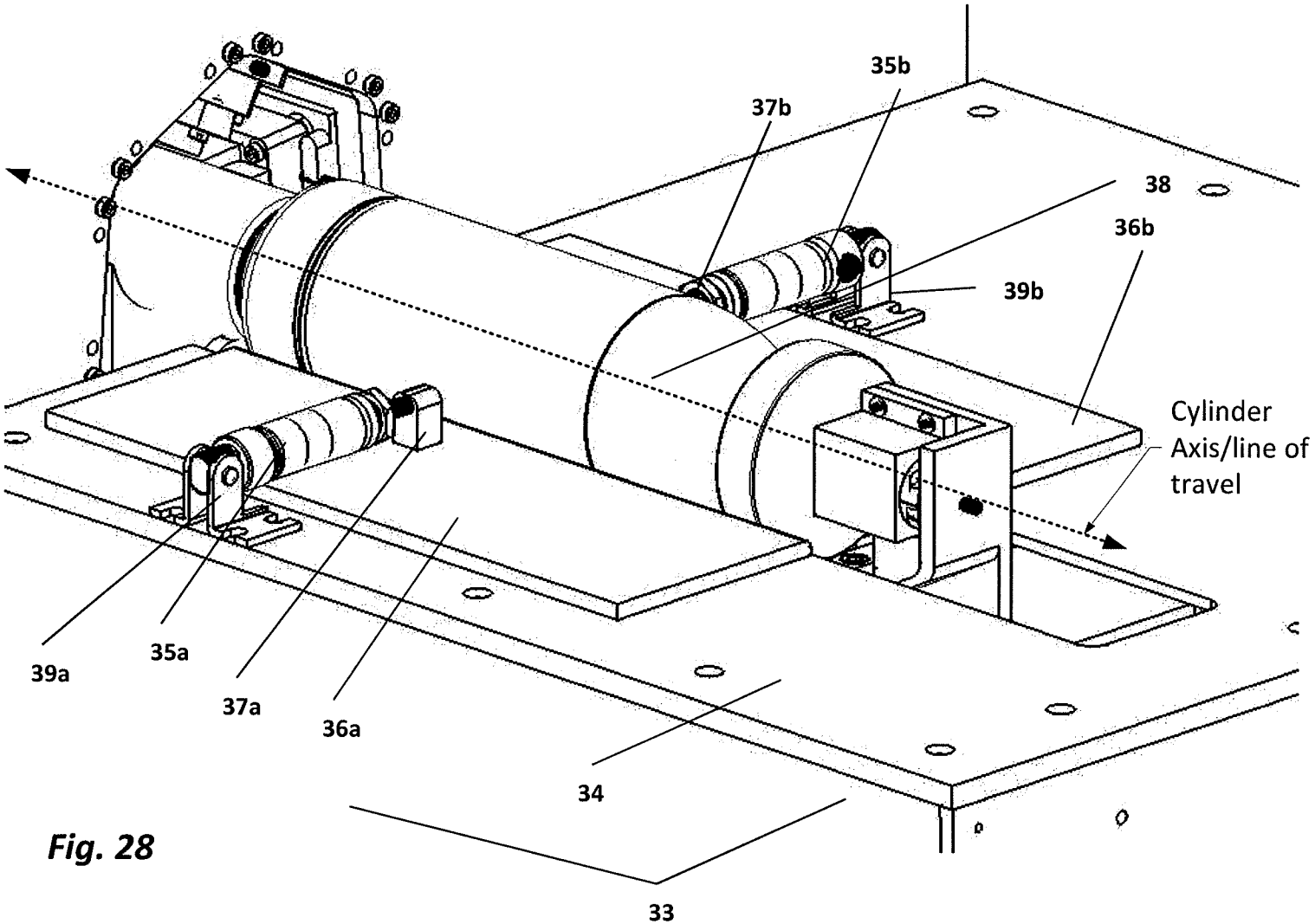
FIG. 28 is a close-up view of the object-centering assembly.
Figure 29:
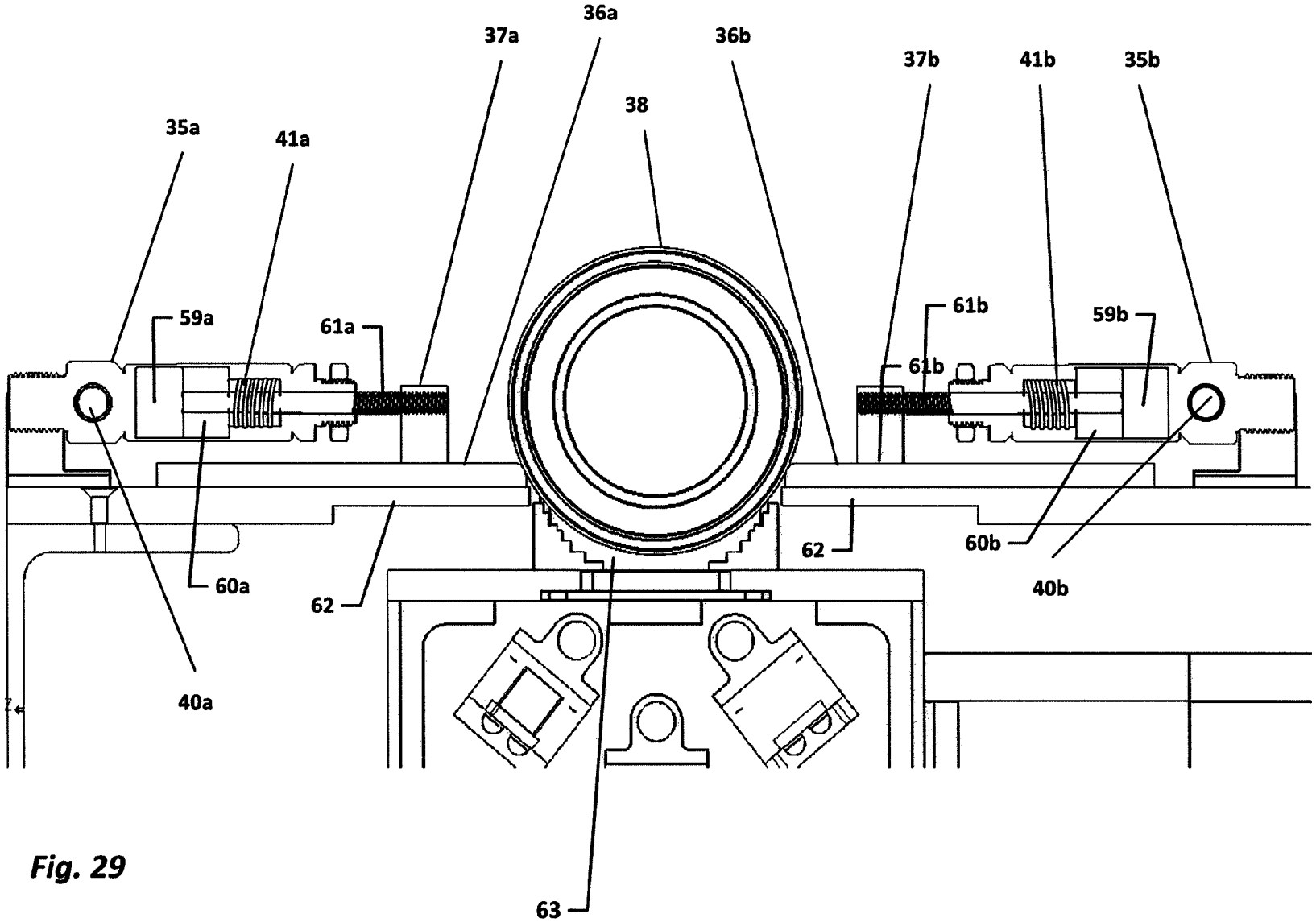
FIG. 29 is a cross-section through the positioning cylinders.

FIG. 28 is a close-up view of the object-centering assembly 33 showing positioning cylinders 35*a*, 35*b* attached directly to the object-centering support 34 via cylinder mounting means 39*a*, 39*b*. Object-centering guides 36*a*, 36*b* are slidably seated upon support surface 62 in which is defined a channel 63 for receiving the partially-cylindrical object to be printed 38, in turn, connected to the positioning cylinders 35*a*, 35*b* via connection blocks 37*a*, 37*b* and are used to center the hollow partially-cylindrical object to be printed 38 for precise printing in the print tunnels 3*a*, 3*b*. Positioning cylinders 35*a*, 35*b* may be achieved using pneumatic cylinders shown in detail in FIG. 29 which depicts a cross-section through the positioning cylinders 35*a*, 35*b* showing the cylinder air supply ports 40*a*, 40*b*. Each cylinder defines a chamber 59 in communication with its respective port 40 and in which is slidably seated a plunger 60 having an arm 61 extending outside the cylinder toward the carriage assembly 42. Air pressure applied into the chamber 59 through the port 40 forces the plunger 60 to pneumatically extend the plunger arm 61, thereby forcing the object-centering guides 36*a*, 36*b* through their respective connections against the surface of the hollow partially-cylindrical object to be printed 38 and so keeps the partially-cylindrical object to be printed 38 centered within the channel 63. The plunger arms 61*a, b* are caused to retract when the air supply at the cylinder air supply ports 40*a*, 40*b* is ceased cylinder springs 41*a*, 41*b* bias the plunger 60 laterally. This centering may be accomplished through a variety of mechanisms other than pneumatic cylinders as would be appreciated by those skilled in the relevant art. Examples of other mechanisms include springs, solenoids, hydraulically actuated plungers, or other suitable mechanisms useful for extension and retraction as indication. Selective application and release of air pressure is rendered by a suitable control system described in detail below. Again the dashed reference line indicates axial alignment of the hollow partially-cylindrical object to be printed 38 along the line of travel.

Figure 30:
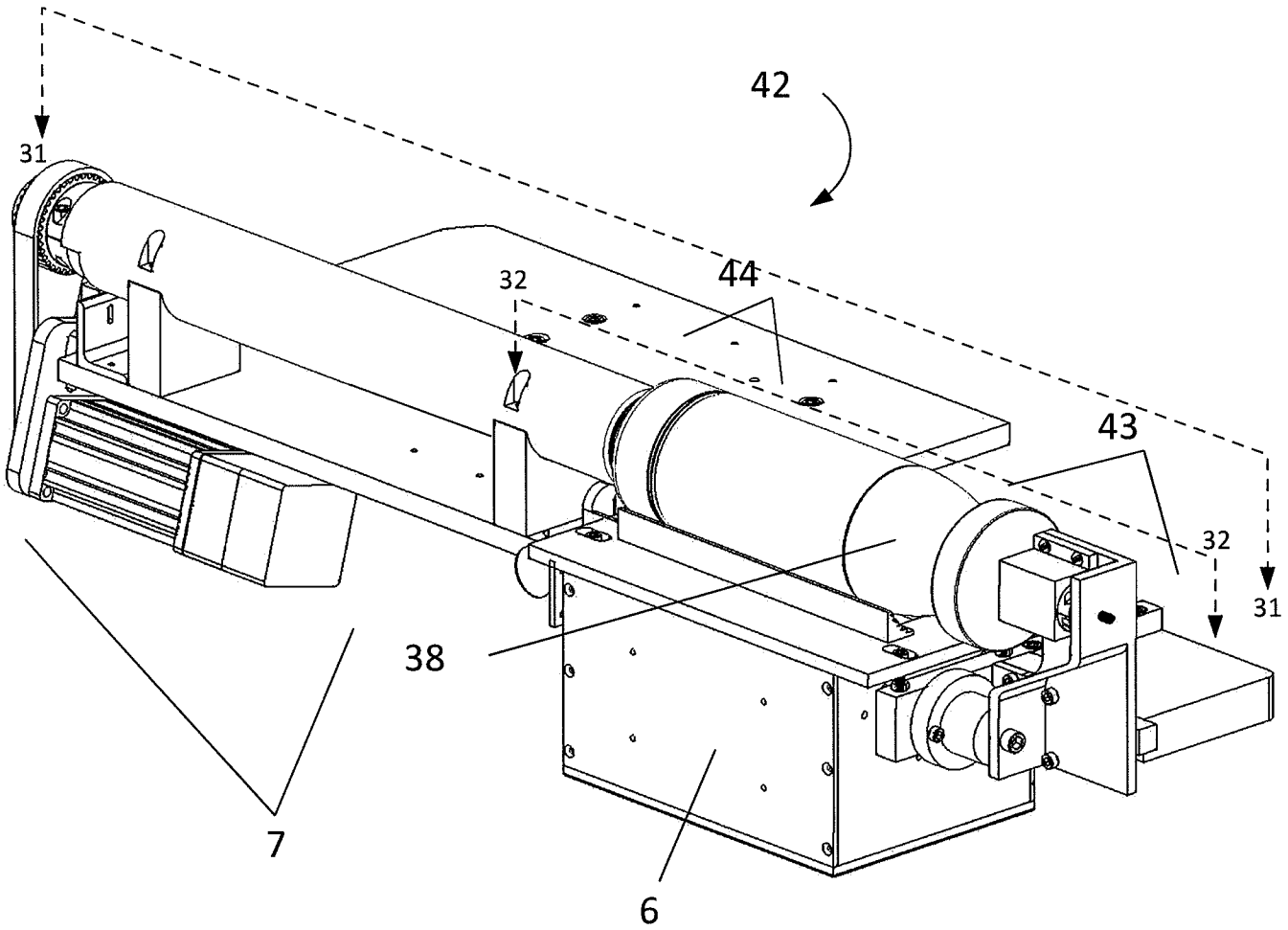
FIG. 30 shows all the components of the carriage assembly.

FIG. 30 shows all the components of the carriage assembly 42, including the rotational drive assembly 7, energy curing assembly 6, hollow partially-cylindrical object to be printed 38, object clamping assembly 43, and object holding assembly 44.

Figure 31:
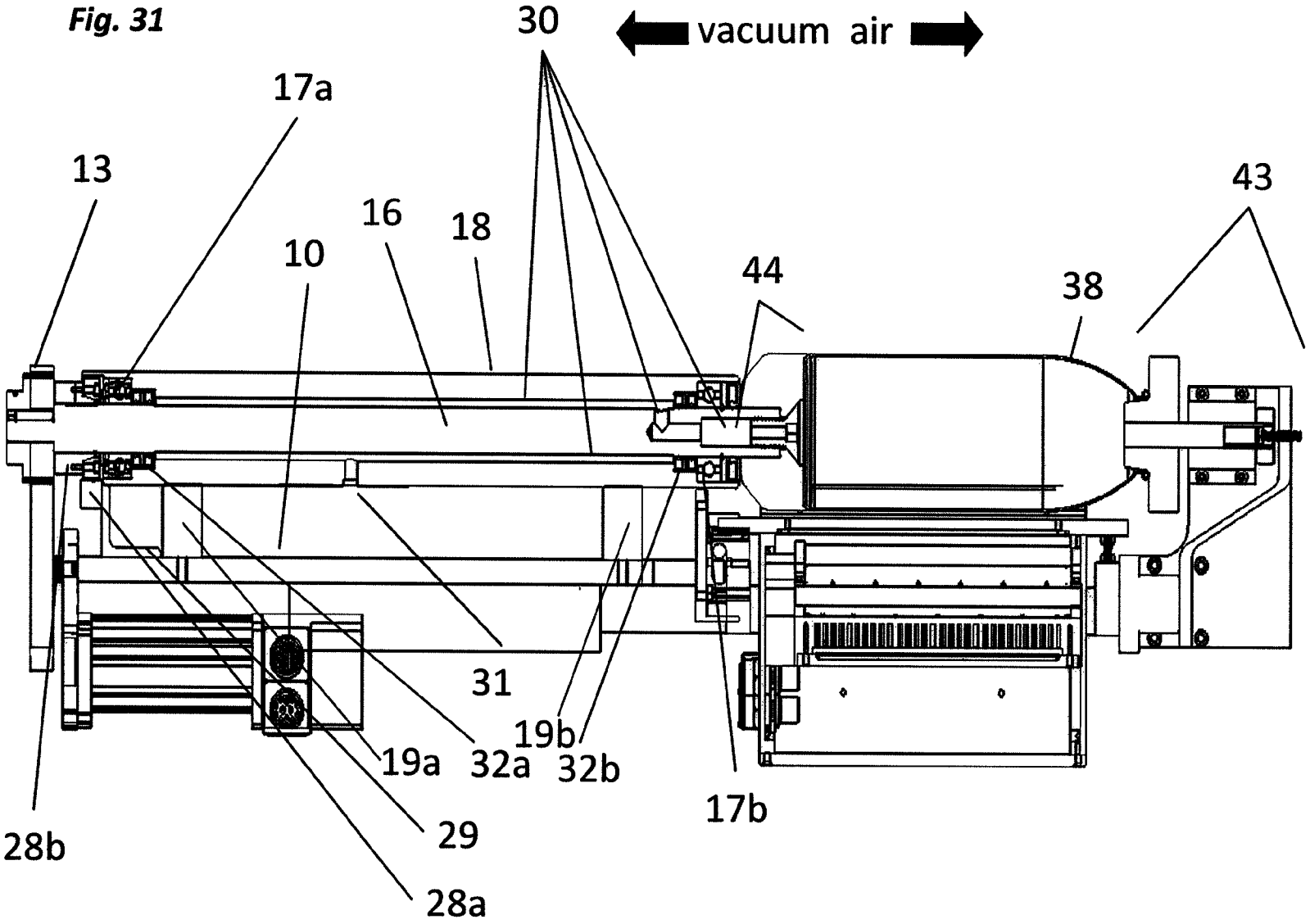
FIG. 31 is a cross-section through the carriage assembly.

FIG. 31 is a cross-section through the carriage assembly 42 shown in FIG. 30 wherein is shown an object holding assembly 44 and its interconnection to the driven pulley 13 of the rotational drive assembly 7 via the drive shaft 16. The drive shaft 16 is mounted via bearings 17*a*, 17*b*, which are mounted within the support tube 18, which is mounted to the carriage mounting plate 10 via support blocks 19*a*, 19*b*. The object holding assembly 44 is connected to the drive shaft 16 and supports the hollow partially-cylindrical object to be printed 38. The object holding assembly 44, drive shaft 16, and support tube 18 are constructed and assembled in such a manner as to create a vacuum/air chamber 30 with an external vacuum/air connection 31 in the sidewall of the support tube 18. As with the previously described embodiment, upon loading the hollow partially-cylindrical object to be printed 38 on the object holding assembly 44, a vacuum is applied via the vacuum/air connection 31, creating a vacuum within the vacuum/air chamber 30 that holds the hollow partially-cylindrical object 38 in place. The air/vacuum chamber 30 is isolated from the atmosphere via sealing means 32*a*, 32*b*. A first part of a rotational position sensing means 28*a* is attached to the carriage mounting plate 10 via a sensor mounting means 29. A second part of a rotational position sensing means 28*b* is directly attached to the drive shaft 16; the rotational position sensing means 28*a*, 28*b* is used to control the precise circumferential deposition of ink to the hollow partially-cylindrical object to be printed 38. Again, when the hollow partially-cylindrical object to be printed 38 is due to be unloaded, the vacuum is released and air pressure may be applied to assist in disengaging the hollow partially-cylindrical object to be printed 38.

Figure 32:
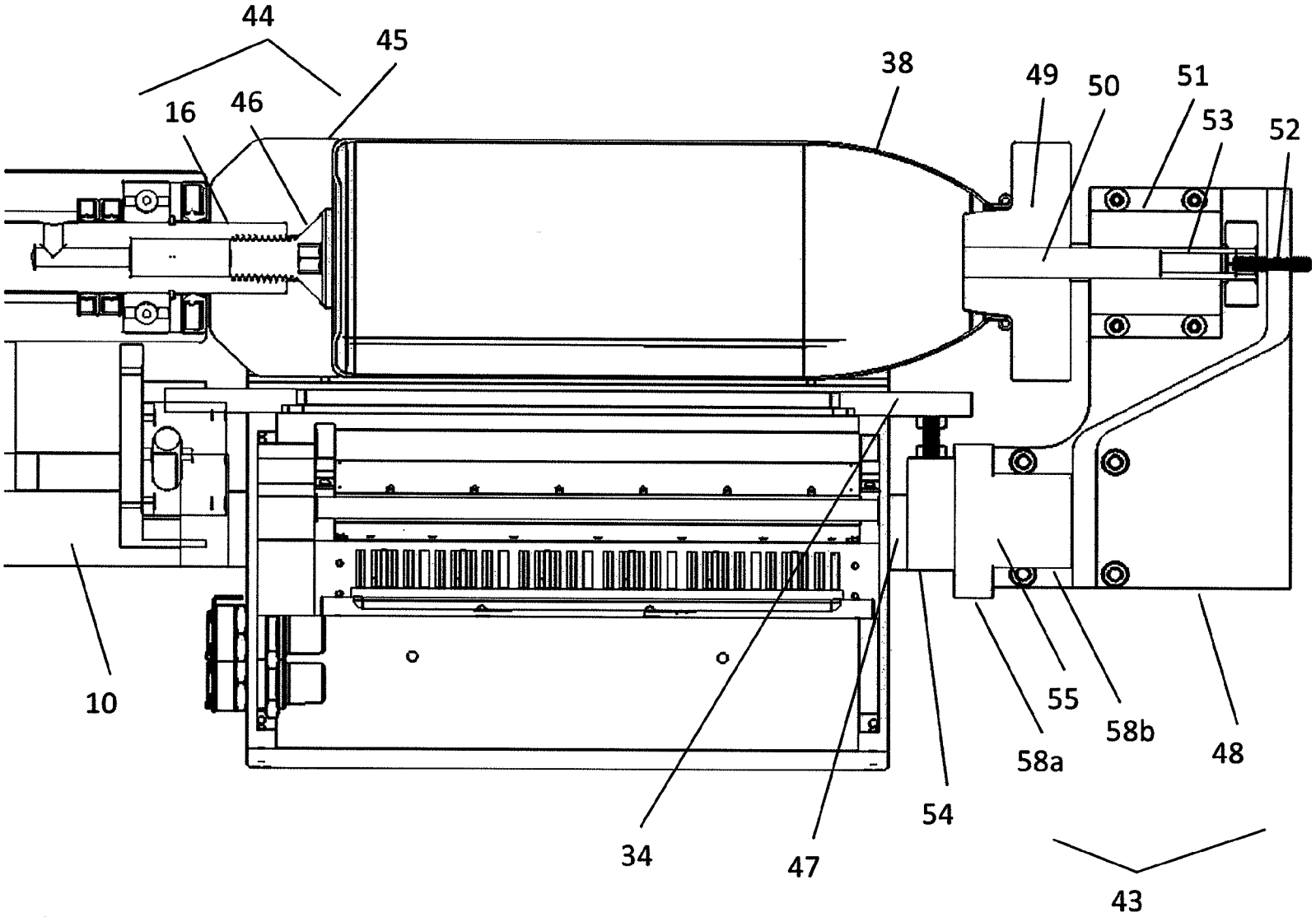
FIG. 32 is a close-up view of a cross-section of the object holding assembly and object clamping assembly.

FIG. 32 is a cross-section of the object holding assembly 44 and object clamping assembly 43 shown in FIG. 30. The object holding assembly 44 consists of a bottle clamp 45 fixedly mounted to the drive shaft 16 via a clamp fastener 46 that also serves the function of applying air and vacuum to the bottom—or closed end—of the hollow partially-cylindrical object 38. The object clamping assembly 43 consists of the object clamping support bracket 48, which is directly attached to the carriage mounting plate 10 via the clamping support plate 47 at the end of the apparatus. A clamping nosepiece 49—attached by a clamping shaft 50 rotating within a pillow block bearing 51 attached to the clamping support bracket 48—supports the open end of the hollow partially-cylindrical object to be printed 38 while allowing said hollow partially-cylindrical object to be printed 38 to rotate freely. The pressure exerted by the clamping nosepiece 49 against the open end of the hollow partially-cylindrical object to be printed 38 may be fine tuned via the pressure adjusting screw 52 preloaded against the clamping shaft 50 via the clamping spring 53. A vertically-adjustable cylinder support plate 54 is fastened to the object-centering support 34 and to the clamping cylinder 55, with the opposite end of the clamping cylinder 55 attached to the clamping support bracket 48. The clamping cylinder 55 is actuated via the cylinder connection ports 58*a* and 58*b*, so that when extended the cylinder 55 pushes the object clamping assembly 43 away from the hollow partially-cylindrical object to be printed 38, thereby causing the clamping nosepiece 49 to release the hollow partially-cylindrical object to be printed 38 so it may be removed from the invention. When the next hollow partially-cylindrical object to be printed 38 is placed against the object holding assembly 44, vacuum is applied within the vacuum/air chamber 30, causing the object holding assembly 44 to hold in place the open end of the hollow partially-cylindrical object to be printed 38. The clamping cylinder 55 is then actuated such that it retracts, causing the object clamping assembly 43 to be pulled toward the hollow partially-cylindrical object to be printed 38, thereby causing the clamping nosepiece 49 to insert into—and position—the open end of the hollow partially-cylindrical object to be printed 38.

Figure 33:
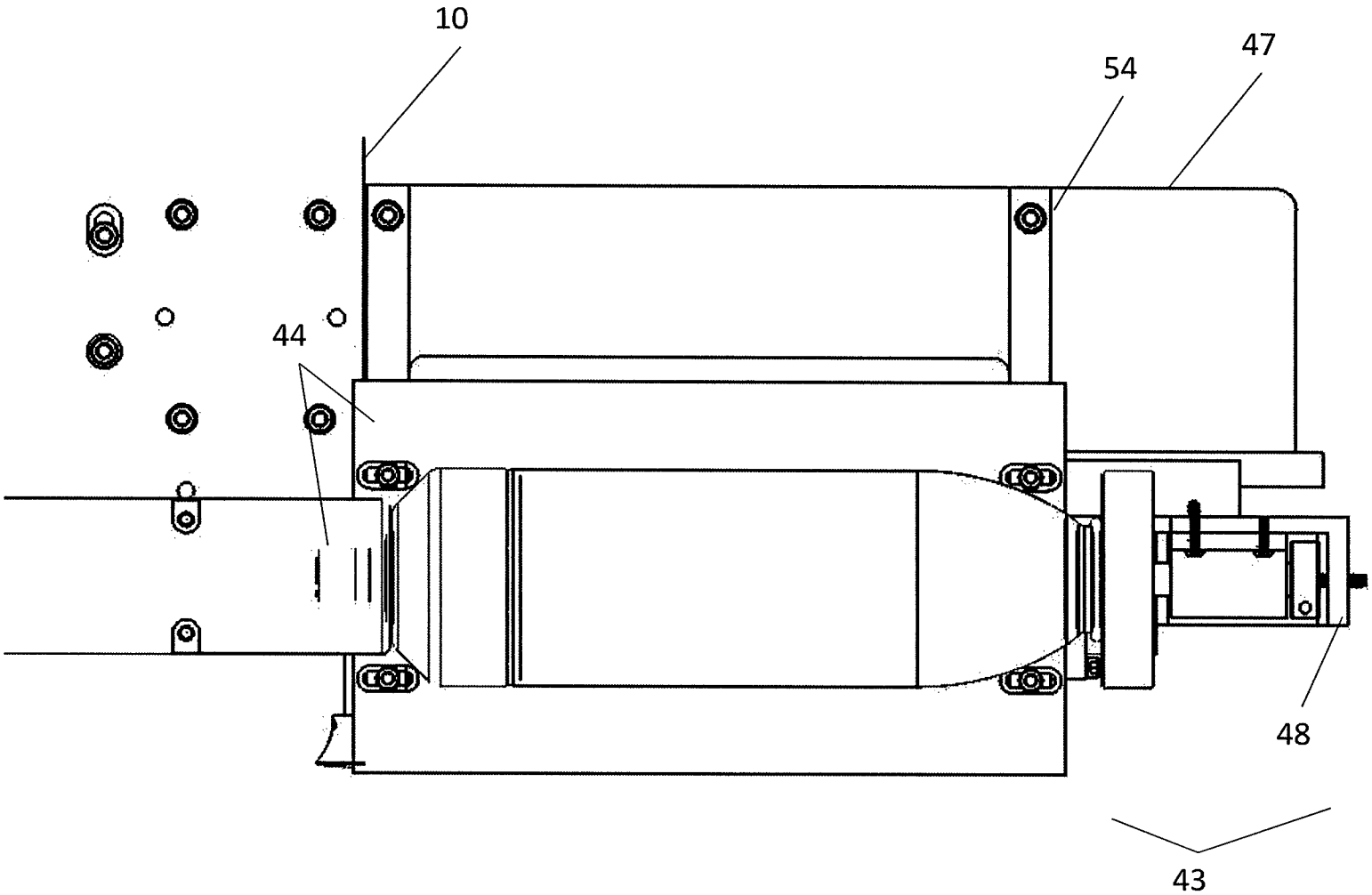
FIG. 33 is a top view of the object clamping assembly and the object holding assembly.

FIG. 33 is a top view of the object clamping assembly 43 and the object holding assembly 44 illustrating the interconnections between the clamping support plate 47, clamping support bracket 48, cylinder support plate 54, and carriage mounting plate 10.

Figure 34:
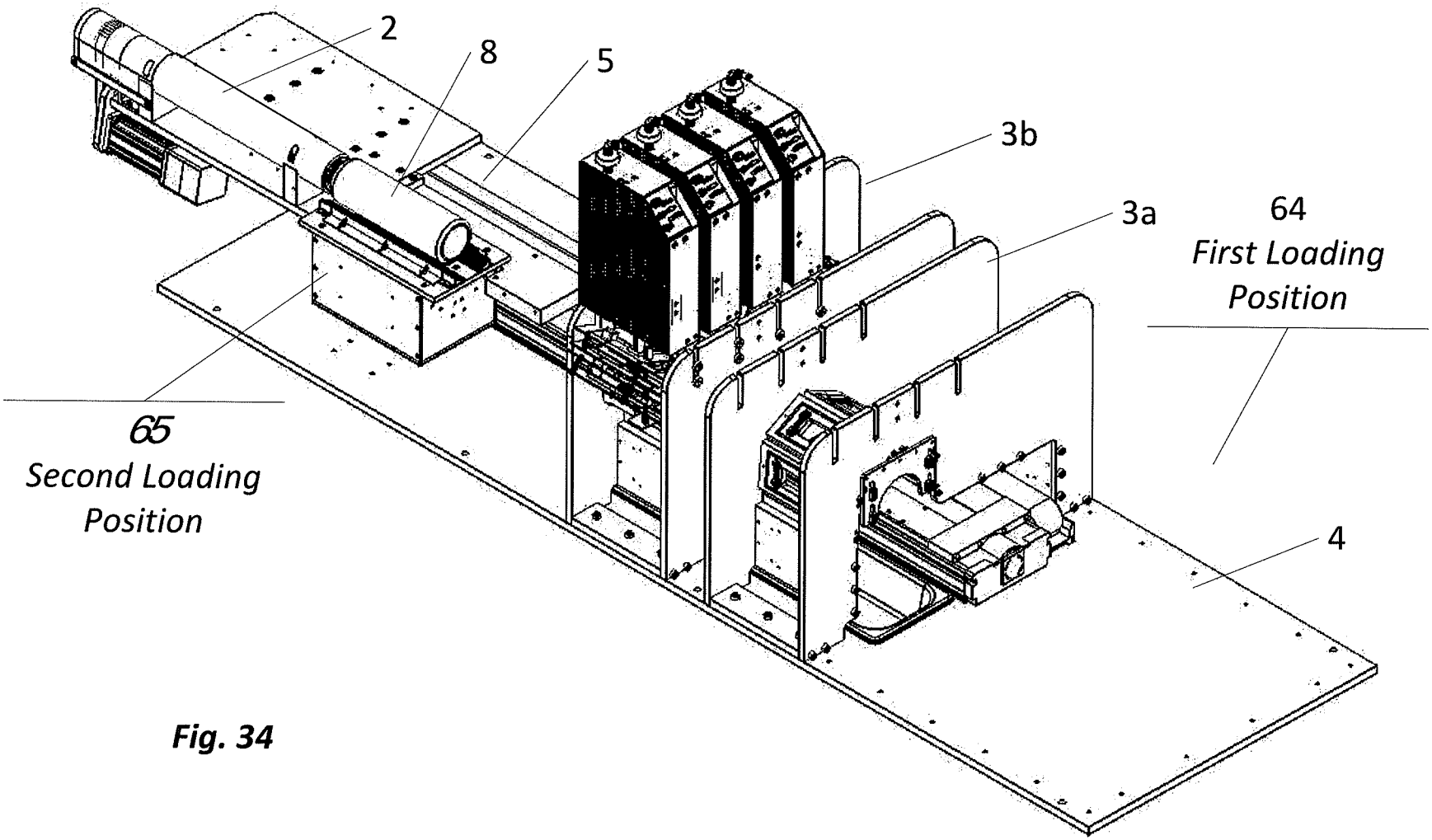
FIG. 34 shows a second exemplary embodiment of a printing apparatus.

A third exemplary embodiment of a printing apparatus is shown in FIG. 34, which depicts a digital printing apparatus for decorating hollow cylindrical objects 8. This third embodiment is a variation of the first embodiment depicted in FIGS. 1 through 26, with the further addition of a secondary loading position 65 axially opposite the first loading position 64. In the preferred operation of this third embodiment the hollow cylindrical object to be printed 8 is loaded at the first loading position 64. The hollow cylindrical object to be printed 8 may be hand-loaded or mechanically loaded via automation, utilizing structures and controls already known in the art. The hollow cylindrical object to be printed 8 linearly advances beneath the first set of printheads 25—as shown in FIG. 21. It continues in identical fashion to the first embodiment of the invention—as shown in FIG. 22—as it is printed. After completion of printing in the requisite number of print tunnels 3—as depicted in FIG. 23, the hollow cylindrical object to be printed 8 continues to axially advance until reaching the secondary loading position 65, axially opposite the first loading position 64—as depicted in FIG. 34, where it is unloaded and the next hollow cylindrical object to be printed 8 is loaded. The hollow cylindrical objects to be printed 8 may be hand-loaded/unloaded or mechanically loaded/unloaded via automation, utilizing structures and controls already known in the art.

After loading at the secondary loading position 65, the hollow cylindrical object to be printed 8 is axially advanced back under the printheads 25, as depicted in FIG. 24, in an axial direction toward the first loading position 64. The hollow cylindrical object to be printed 8 reaches the first loading position 64, where it is unloaded and the next hollow cylindrical object to be printed 8 is loaded. The hollow cylindrical objects to be printed 8 may be hand-loaded/unloaded or mechanically loaded/unloaded via automation, utilizing structures and controls already known in the art In another operation of the third embodiment of the invention, these forward and reverse passes through the print tunnel (s) 3 may continue for as many repetitions as required to complete the intended design, being dictated by the desired print design and resolution, hollow cylindrical object to be printed 8 diameter and length, printhead 25 length and deposition rate, desired ink density, as well as axial displacement, or staggering of the printheads 25 to achieve the desired results. In this embodiment, the total number of passes—both forward and reverse—would by convention be an odd number (3, 5, 7, etc.) as an even number of passes would insinuate only a first loading position 64, which is described within the first embodiment of the invention.

Figure 35:
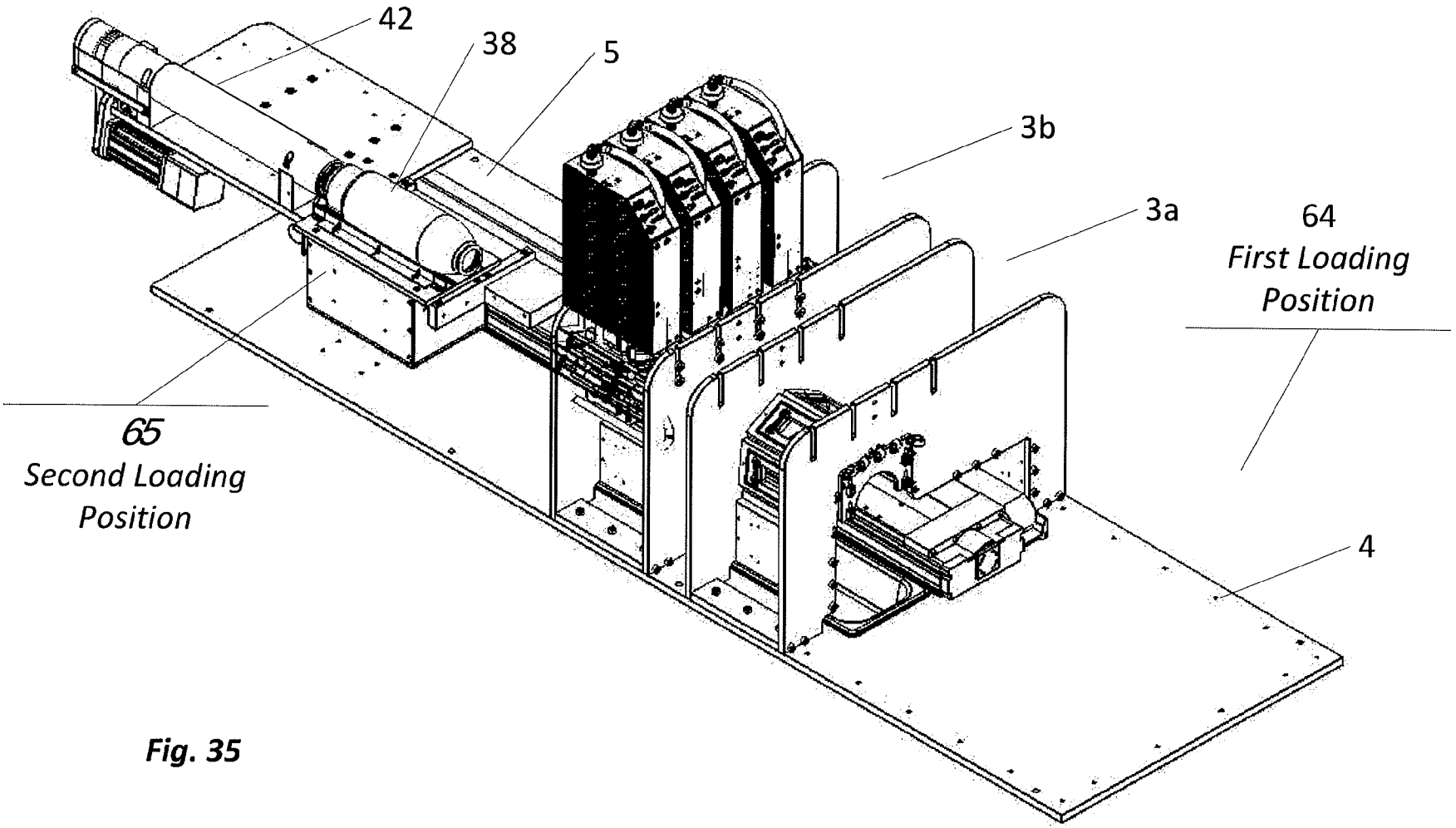
FIG. 35 shows a fourth exemplary embodiment of a printing apparatus.

A fourth exemplary embodiment of a printing apparatus is shown in FIG. 35, which depicts a digital printing apparatus for hollow partially-cylindrical objects (or bottles) 42. This fourth embodiment is a variation of the second embodiment depicted in FIGS. 27 through 33, with the further addition of a secondary loading position 65 axially opposite the first loading position 64.

In the preferred operation of this fourth embodiment for hollow partially-cylindrical object to be printed 38—as with the preferred operation of the third embodiment for hollow cylindrical object to be printed 8—the hollow partially-cylindrical object to be printed 38 axially advances beneath the first set of printheads 25 after being loaded at the first loading position 64. After completion of printing in the requisite number of print tunnel(s) 3, the hollow partially-cylindrical object to be printed 38 continues to axially advance until reaching the secondary loading position 65, axially opposite the first loading position 63—as depicted in FIG. 35, where it is unloaded and the next hollow partially-cylindrical object to be printed 38 to be printed is loaded. The hollow partially-cylindrical objects to be printed 38 may be hand-loaded/unloaded or mechanically loaded/unloaded via automation, utilizing structures and controls already known in the art.

In another operation of the fourth embodiment, these forward and reverse passes through the print tunnel(s) 3 may continue for as many repetitions as required to complete the intended design, as dictated by desired print design and resolution, hollow partially-cylindrical object to be printed 38 diameter and length, printhead 25 length and deposition rate, desired ink density, as well as axial displacement, or staggering of the printheads 25 to achieve the desired results. In this embodiment, the total number of passes—both forward and reverse—would by convention be an odd number (3, 5, 7, etc.) as an even number of passes would insinuate only a first loading position 64, which is described above with in reference to the first embodiment above.

Functions of the apparatus described above are controlled through instructions executed by a computer-based control system 70 which may be housed in the support frame 4. A control system 70 suitable for use with all embodiments described above includes, for example, one or more processors. The computer system 70 can also include a main memory, preferably a random access memory (RAM), and can also include a secondary memory. The secondary memory can include, for example, a hard disk drive and/or a removable storage drive. The removable storage drive reads from and/or writes to a removable storage unit in a well-known manner. The removable storage unit, represents a floppy disk, magnetic tape, optical disk, and the like, which is read by and written to by the removable storage drive. The removable storage unit includes a computer usable storage medium having stored therein computer software and/or data.

The secondary memory can include other similar means for allowing computer programs or other instructions to be loaded into the computer system. Such means can include, for example, a removable storage unit and an interface. Examples of such can include a program cartridge and cartridge interface (such as that found in video game devices), a removable memory chip (such as an EPROM, or PROM) and associated socket, and other removable storage units and interfaces which allow software and data to be transferred from the removable storage unit to the computer system.

Computer programs (also called computer control logic) are stored in the main memory and/or secondary memory. Computer programs can also be received via a communications interface. Such computer programs, when executed, enable the computer system to perform certain features of the present invention as discussed herein. In particular, the computer programs, when executed, enable a control processor to perform and/or cause the performance of features of the present invention. Accordingly, such computer programs represent controllers of the computer system.

In an embodiment where the invention is implemented using software, the software can be stored in a computer program product and loaded into the computer system using the removable storage drive, the memory chips or the communications interface. The control logic (software), when executed by a control processor, causes the control processor to perform certain functions of the embodiments described herein.

In other embodiments, features of the apparatus are implemented primarily in hardware using, for example, hardware components such as application specific integrated circuits (ASICs) or field-programmable gated arrays (FPGAs). Implementation of the hardware state machine so as to perform the functions described herein will be apparent to persons skilled in the relevant art(s). In yet another embodiment, features of the invention can be implemented using a combination of both hardware and software.

As described above and shown in the associated drawings, the present invention comprises apparatuses for printing on generally cylindrical objects and related methods. While particular embodiments of the invention have been described, it will be understood, however, that the invention is not limited thereto, since modifications may be made by those skilled in the art, particularly in light of the foregoing teachings. It is, therefore, contemplated by the appended claims to cover any such modifications that incorporate those features or those improvements that embody the spirit and scope of the present invention.

What is claimed is:

1. An ink jet printer for printing on an at least partially cylindrical object, said object having a cylindrical portion including a surface defined by points at a fixed radius from an axis, said printer comprising:

a plurality of printheads in communication with a fluid supply and positioned with respect to a line of travel aligned with said axis along which an at least partially cylindrical object is to be conveyed, each of said plurality of printheads being controlled to selectively deposit fluid upon a surface of said object in accordance with a pre-determined image, and wherein a first printhead is axially displaced with respect to a second printhead;

a curing device located along said line of travel and configured to emit energy suitable to cure fluid deposited upon the surface of said object; and a carriage assembly configured to hold said object such that said axis is aligned axially along said line of travel and to axially convey said object bi-directionally along said line of travel, position said object relative to said plurality of printheads, and to rotate said object relative to said plurality of printheads, and to position said object relative to said curing device; and wherein said plurality of printheads is controlled to selectively deposit fluid upon said surface of said object when said object is conveyed in either direction.

2. The ink jet printer of claim 1, wherein said curing device is configured to emit said energy when said object is conveyed in either direction.

3. The ink jet printer of claim 2, wherein said carriage assembly further comprises a mandrel having a free end dimensioned to be inserted into a hollow cylindrical object, said mandrel being coupled to a rotating drive shaft.

4. The ink jet printer of claim 3, wherein said mandrel further defines a chamber having an opening at said free end, said chamber in fluid communication with a conduit such that a substantial vacuum may be created within said chamber sufficient to draw said object against said free end.

5. The ink jet printer of claim 1, wherein said plurality of printheads comprises a print tunnel arranged in an arch above said line of travel.

6. The ink jet printer of claim 5, further comprising at least two print tunnels arrayed in tandem along said line of travel.

7. The ink jet printer of claim 5, wherein said carriage assembly further comprises opposing clamping and holding assemblies configured to hold a partially cylindrical object axially aligned with the line of travel, said holding assembly being coupled to a rotating drive shaft.

8. The ink jet printer of claim 7, wherein said carriage assembly further comprises a centering guide for maintaining lateral alignment of said object.

9. The ink jet printer of claim 6, wherein said curing device is configured to emit said energy when said object is conveyed in either direction.

10. The ink jet printer of claim 9, further comprising a generally cylindrical mandrel having a free end dimensioned to be inserted into a hollow cylindrical object and supported by said carriage assembly such that it is axially aligned along said line of travel, said mandrel being coupled to a rotating drive shaft.

11. The ink jet printer of claim 10, wherein said mandrel further defines a chamber having an opening at said free end, said chamber in fluid communication with a conduit such that a substantial vacuum may be created within said chamber sufficient to draw said object against said free end.

12. A computer-controlled apparatus for printing an image on an at least partially cylindrical object, said image being represented in computer-readable media, said apparatus comprising:

a carriage assembly for supporting an at least partially cylindrical object, moving said object bi-directionally along a line of travel, said line of travel being aligned with an axis defining a cylindrical portion of said at least partially cylindrical object, and rotating said object about said axis;

a plurality of printheads positioned with respect to said axis, each of said plurality of printheads configured to selectively deposit fluid upon a surface of said object when said object is moved in either direction, and wherein a first printhead is axially displaced with respect to a second printhead;

a curing device located along said axis and configured to emit energy suitable to cure fluid deposited upon the surface of said object; and a computer-based system in communication with said carriage assembly, said plurality of printheads and said curing device, said computer-based system being configured with control logic control position of the carriage assembly bi-directionally along said axis, rotation of said object, deposition of said fluid through said printheads, and emission of energy, in accordance with said image.

13. The apparatus of claim 12, wherein said computer-based system is configured to control said curing device such that said device selectively emits said energy when said object is moved in either direction.

* * * * *